US011851968B2

(12) United States Patent
Eriksen et al.

(10) Patent No.: US 11,851,968 B2
(45) Date of Patent: Dec. 26, 2023

(54) PLUG ASSEMBLY

(71) Applicant: TCO AS, Indre Arna (NO)

(72) Inventors: Tommy Eriksen, Voss (NO); Bård Angell, Røyneberg (NO)

(73) Assignee: TCO AS, Indre Arna (NO)

( * ) Notice: Subject to any disclaimer, the term of this patent is extended or adjusted under 35 U.S.C. 154(b) by 10 days.

(21) Appl. No.: 17/883,723

(22) Filed: Aug. 9, 2022

(65) Prior Publication Data

US 2023/0089352 A1 Mar. 23, 2023

Related U.S. Application Data

(63) Continuation-in-part of application No. 17/480,805, filed on Sep. 21, 2021, now Pat. No. 11,441,382.

(51) Int. Cl.
*E21B 33/12* (2006.01)
*E21B 29/02* (2006.01)

(52) U.S. Cl.
CPC ..... *E21B 29/02* (2013.01); *E21B 33/12* (2013.01)

(58) Field of Classification Search
CPC ..... E21B 33/1208
See application file for complete search history.

(56) References Cited

U.S. PATENT DOCUMENTS

| | | | | |
|---|---|---|---|---|
| 9,732,579 | B2 * | 8/2017 | Hiorth | E21B 33/1208 |
| 10,934,802 | B2 * | 3/2021 | Brandsdal | E21B 33/1208 |
| 11,149,522 | B2 * | 10/2021 | Brandsdal | E21B 33/1208 |
| 2016/0060998 | A1 * | 3/2016 | Hiorth | E21B 33/12 166/192 |
| 2018/0313183 | A1 * | 11/2018 | Hiorth | E21B 33/12 |
| 2019/0017345 | A1 * | 1/2019 | Brandsdal | E21B 33/1208 |
| 2019/0032448 | A1 * | 1/2019 | Bjorgum | E21B 33/134 |
| 2021/0164316 | A1 * | 6/2021 | Brandsdal | E21B 33/1208 |
| 2021/0340836 | A1 * | 11/2021 | Brandsdal | E21B 33/1208 |

* cited by examiner

*Primary Examiner* — Steven A MacDonald
(74) *Attorney, Agent, or Firm* — Flener IP & Business Law; Zareefa B. Flener

(57) ABSTRACT

A plug system including: a plug tubular including a tubular body, an upstream tubular connection, and a downstream tubular connection; wherein: the upstream tubular connection and the downstream tubular connection are openings at opposite ends of the tubular body; and a plug assembly arranged in a housing including: a plug; a breaker object; and a seat; wherein: the plug is supported by the seat; the plug assembly has a first position and a second position; wherein in the first position, the plug intact; and in the second position the plug has been broken by the breaker object; wherein: the plug is stationary with respect to the housing in both the first and second position; there is a fluid connection between the upstream tubular connection and the downstream tubular connection: and the tubular body is a single continuous piece; and wherein the plug assembly is entirely arranged within the plug tubular.

20 Claims, 15 Drawing Sheets

PLUG ASSEMBLY

CROSS REFERENCES TO PREVIOUS APPLICATIONS

The present application is a Continuation in Part of, and claims priority to, U.S. application Ser. No. 17/480,805 filed Sep. 21, 2021; hereby incorporated by reference.

FIELD OF INVENTION

The present invention relates to a plug assembly deactivated by a pressure differential for use in petroleum well boreholes. The present invention also relates to a plug system comprising said plug assembly. More particularly the assembly is for the temporary blocking of fluid flow through a tubular.

During the drilling, testing, completion, fracking, production and abandonment stages of hydrocarbon wells there are many uses for plugs assemblies that create a fluid barrier in the well. Some of these uses are not permanent such as plug and abandonment, but rather temporary, where it is desired to reestablish fluid flow at a later stage. Some examples of such temporary uses of plugs are for flotation, well testing during completion, packer setting and fluid loss devices.

Flotation is used in horizontal parts of a well to reduce friction in the hole when the casing or liner is run into place in the well. An air chamber is then formed in the pipe between a mechanical valve or plug assembly in the bottom (the toe) of the casing and a plug assembly installed further towards the surface, usually in the portion of the well where it turns vertical (the heel). This enables the casing or liner in the horizontal part of the well to "float" into place, after which the plug assembly must be removed or opened and the valve opened to make the well ready for subsequent operations such as cementing, pressure testing and production.

As the well is completed, the integrity of the casing and production tubing is tested to make sure it will not leak during the different conditions expected during oil and gas production. It is then necessary to be able to isolate sections of the well and test them separately. By installing a plug assembly it is possible to do such testing, and then the plug assembly must be opened or removed before production.

Plug assemblies can also be used as a barrier in the production tubing allowing it to be pressured up when a packer is to be set in order to seal the annulus between the production tubing and casing. It is necessary to open or remove the plug assembly later.

The plug assembly according to the present invention is suitable for the above-mentioned uses, but these are only examples of use and not a limiting list, the plug assembly can also be used for other downhole applications.

BACKGROUND

There are many available types of plug assemblies that can be removed or deactivated/opened. The plug assembly can for example be pulled out of the well using coiled tubing or wireline. But this can lead to problems, such as damage to the tubing, and take up a lot of valuable rig time. The plug assembly can also be speared or milled, but this has similar disadvantages. The mentioned plug assemblies usually comprise metal plugs, and the removal thereof often result in the presence of undesired parts or pieces of debris in the well. Plugs can also be made out of dissolvable materials, but then the conditions at which they are to be used must be very well known and appropriate for the particular dissolvable material, and this allows for no deviation in the time schedule. Other materials such as rubber or composites also have drawbacks, often relating to their sensitivity to the high pressure and temperature found in many wells, as well as the chemically harsh environment therein.

Frangible materials such as glass or ceramics have the advantage of being relatively insensitive to pressure, temperature and chemical corrosion, yet by their frangible nature they are relatively easy to destroy when used as the fluid blocking part of plug assemblies. Glass in particular can be made to break into very small pieces that will not pose a problem in most wells. Frangible materials therefore allows for additional ways of opening the plug assembly, such as constructing the plug assembly with small amounts of explosives that will crush or shatter a glass disc, and open the plug assembly, but not damage the production tubing or casing the plug assembly is installed in. However, when using explosives there is always a risk of explosives or parts thereof remaining undetonated in the well, and the transport and handling during installation of plugs fitted with explosives is complicated as many safety-related conditions must be taken into consideration. Breaking frangible discs in plug assemblies without using explosives is therefore advantageous.

In general, the means for opening a plug assembly by destroying a plug such as a frangible disc comprised therein are usually incorporated into or placed on or in contact with the plug, but can also be placed at some distance from the plug but still in the plug assembly, i.e. in the plug assembly housing. Usually said means are installed as part of or at the same time as the plug assembly.

The simplest way to destroy a frangible disc is arguably to apply direct force to it with a breaker. This allows for simple mechanical solutions. The breaker will then make contact with the frangible disc on a relatively small area, the disc impact surface. Frangible materials such as glass and ceramics can be designed to withstand the high pressures found in hydrocarbon wells, but if exposed to impact on only a very small area they will typically shatter, and this property of breaking under a large point pressure load is taken advantage of by employing a breaker with a relatively small impact area. The breaker could be a thin edge such as a knife blade, a point such as a pin, or even a small ball or other rounded structure since only a very small part thereof would make contact with the frangible disc. The shape thereof is less important than that the contact area between the breaker and the plug impact surface is small, so relatively small amounts of force applied relatively quickly can break the plug. It is also possible to weaken the plug at the point of contact during its construction, so that it is crushed more easily.

Relative movement is then also required, i.e. the breaker must move relative to the plug. This can be achieved by either the plug or breaker moving towards the other, depending on what kind of frangible disc breaking system is employed. Different systems have been developed to achieve this, including use of electrical signals and hydraulic fluids, and pressure. Since it is possible to control how much pressure is applied to the plug assembly and plug therein directly from the surface, using this pressure directly to break the plug is possible. This is an elegant and simple solution, as it does not require signals of any kind to be routed from the surface to the plug assembly, one simply applies pressure from the wellhead and this in turn mechanically actuates movement of the breaker onto the disc impact surface. This pressure from the wellhead is then often to some extent countered by the pressure from downhole, i.e.

from the hydrocarbon formation. The specific pressure that is then needed to open a given plug assembly is then the pressure differential between the pressures applied form both downhole and uphole.

Another way to remove a frangible plug is to break it in place. In other words, the plug does not need to move relative to the breaker. This can be accomplished by using an explosive. The explosive is then installed so that when it explodes this breaks the plug. The explosive thus acts as breaker. Another example of breaking the frangible plug in place is to simply apply enough pressure from the wellhead to cause the plug to break against an element that it is contact with.

The details of how this actuation occurs varies between the known systems. In designing such a system there are several considerations that should be taken:

It is desired to use as few as possible components, and especially as few as possible moving components, to minimize the risk of said components breaking or getting stuck during operation, and to ease manufacture thereof.

It is crucial to avoid accidental actuation, i.e. accidental or early breaking of the plug. The system should therefore preferably comprise safety measures to prevent this.

The plug must be installed in such a way that it is well secured, and will not break unintentionally from fluctuating well pressures (i.e. from direct pressure rather than from the impact of a breaker).

The plug should preferably be secured in such a way that it forms a fluid tight barrier in the pipe where it is installed until it is broken.

The plug should preferably break into fragments small enough to not be a potential problem in the well.

The various parts of the plug assembly should preferably be prevented from entering the wellbore, so they or pieces thereof will not be a potential problem in the well.

The various parts of the plug assembly should preferably be prevented from moving once the plug assembly is opened.

Leakage of fluid between the plug tubular and the surrounding area, such as the annulus, should be prevented as far as possible.

There should not be a possibility of a partial opening of the plug, i.e. the system should preferably only allow for the plug to be fully intact or fully broken, not partially broken. If partially broken, it would not be possible to open fully with pressure from above since a partially open plug assembly could not be pressurized, so different means to open it fully would have to be used.

The inner diameter of the tubing the plug assembly is installed in should preferably be fully restored upon opening of the plug assembly, i.e. the plug assembly should not have a smaller inner diameter than the inner diameter below and above the plug assembly. This allows for a nonrestricted fluid flow past the opened plug assembly.

SHORT SUMMARY OF THE INVENTION

As described above, there is a need for plug assemblies comprising a frangible disc that can be opened by controlled application of pressure from above the plug assembly. Technical problems with existing plug assemblies are typically related to that they are not robust enough and may comprise many parts, especially movable parts, increasing the chance of malfunction, especially in harsh well conditions with high pressure and/or temperature and very corrosive fluids. It is therefore the object of the present invention to provide a plug assembly comprising a plug that can hold pressure while being used for its purpose, and then be safely and completely opened after it has served its purpose with a mechanism for breaking the plug that is strong enough to support the frangible disc and able to in a controlled and predictable manner break the frangible disc with a breaker. The plug assembly should be designed so the breaking will happen at a specific, preset pressure value applied from above the plug assembly. This preset value should be predictable and repeatable. It should be possible to change by changing as few as possible of the plug assembly parts, in order for it to be feasible to produce plug assemblies with different opening differential pressure values. Once open, the plug assembly parts should stay in place, and said parts or pieces thereof should not enter the wellbore. The plug assembly in accordance with the present invention does provide these advantages.

In some aspects, the techniques described herein relate to a plug assembly arranged in a housing in a tubular body including: a plug; a breaker object; a seat; and an assembly retainer wherein: the plug is supported by the seat; the assembly retainer supports the plug assembly; and the assembly retainer is stationary with respect to the housing, and the assembly retainer is a separate element from the tubular body; further: the plug assembly has a first position and a second position; wherein: in the first position, the plug is intact; and in the second position the plug has been broken by the breaker object; wherein the assembly retainer is fixed to the tubular body by a retainer connector, and: the plug is stationary with respect to the housing in both the first and second position.

In some aspects, the techniques described herein relate to a plug assembly, wherein the breaker object is an explosive. In some aspects, the techniques described herein relate to a plug assembly, wherein the breaker object is the seat.

In some aspects, the techniques described herein relate to a plug assembly, wherein the assembly retainer includes threads to affix the retainer assembly to the housing. In some aspects, the techniques described herein relate to a plug assembly, wherein the assembly retainer further includes a retainer dampener to absorb force after the plug assembly is no longer in the first position. In some aspects, the techniques described herein relate to a plug assembly, wherein the assembly retainer further includes a retainer body and wherein the retainer body includes threads to affix the assembly retainer to the housing.

In some aspects, the techniques described herein relate to a plug assembly, wherein the assembly retainer further includes a plurality of retainer segments. In some aspects, the techniques described herein relate to a plug assembly, wherein at least one of the plurality of retainer segments includes a retainer body and a retainer protrusion, wherein the retainer protrusion extends from the retainer body in a radial direction.

In some aspects, the techniques described herein relate to a plug assembly, wherein the plug assembly further includes a retainer ring to affix the retainer segments to the housing, wherein at least a portion of the retainer body is arranged between the housing and a portion of the retainer ring.

In some aspects, the techniques described herein relate to a plug assembly, wherein the breaker object is stationary with respect to the plug between the first and second position.

In some aspects, the techniques described herein relate to a plug system including: a plug tubular including a tubular body, an upstream tubular connection, and a downstream tubular connection; wherein: the upstream tubular connection and the downstream tubular connection are openings at opposite ends of the tubular body; and a plug assembly arranged in a housing including: a plug; a breaker object; and a seat; wherein: the plug is supported by the seat; the plug assembly has a first position and a second position; wherein in the first position, the plug intact; and in the second position the plug has been broken by the breaker object; wherein: the plug is stationary with respect to the housing in both the first and second position; there is a fluid connection between the upstream tubular connection and the downstream tubular connection: and the tubular body is a single continuous piece; and wherein the plug assembly is entirely arranged within the plug tubular.

In some aspects, the techniques described herein relate to a plug system, wherein the breaker object is an explosive. In some aspects, the techniques described herein relate to a plug system, wherein the breaker object is the seat.

In some aspects, the techniques described herein relate to a plug system, wherein the breaker object is stationary with respect to the plug between the first and second position.

In some aspects, the techniques described herein relate to a plug system, wherein the plug assembly further includes an assembly retainer arranged to support the breaker or the shear ring and the assembly retainer is stationary with respect to the housing.

In some aspects, the techniques described herein relate to a plug system, wherein the assembly retainer includes threads to affix the retainer assembly to the housing. In some aspects, the techniques described herein relate to a plug system, wherein the assembly retainer further includes a retainer body and wherein the retainer body includes threads to affix the assembly retainer to the housing. In some aspects, the techniques described herein relate to a plug system, wherein the assembly retainer further includes a plurality of retainer segments.

In some aspects, the techniques described herein relate to a plug system, wherein at least one of the plurality of retainer segments includes a retainer body and a retainer protrusion, wherein the retainer protrusion extends from the retainer body in a radial direction.

In some aspects, the techniques described herein relate to a plug system, wherein the plug system further includes a retainer ring to affix the retainer segments to the housing, wherein at least a portion of the retainer body is arranged between the housing and a portion of the retainer ring.

In some aspects, the techniques described herein relate to a plug assembly, wherein the assembly retainer further comprises a retainer connector and wherein the retainer connector affixes the retainer assembly to the housing.

In some aspects, the techniques described herein relate to a plug assembly, wherein the assembly retainer includes threads to affix the retainer assembly to the housing.

In some aspects, the techniques described herein relate to a plug assembly, wherein the assembly retainer further includes a retainer dampener to absorb force after the plug assembly is no longer in the first position.

In some aspects, the techniques described herein relate to a plug assembly, wherein the assembly retainer further includes a retainer body and wherein the retainer body includes threads to affix the assembly retainer to the housing.

In some aspects, the techniques described herein relate to a plug assembly, wherein the assembly retainer further includes a plurality of retainer segments.

In some aspects, the techniques described herein relate to a plug assembly, wherein at least one of the plurality of retainer segments includes a retainer body and a retainer protrusion, wherein the retainer protrusion extends from the retainer body in a radial direction.

In some aspects, the techniques described herein relate to a plug assembly, wherein the plug assembly further includes a retainer ring to affix the retainer segments to the housing, wherein at least a portion of the retainer body is arranged between the housing and a portion of the retainer ring.

In some aspects, the techniques described herein relate to a plug system, wherein the plug assembly further includes an assembly retainer arranged to support the breaker and the assembly retainer is stationary with respect to the housing.

In some aspects, the techniques described herein relate to a plug system, wherein the assembly retainer further including a plurality of retainer segments.

In some aspects, the techniques described herein relate to a plug system, wherein at least one of the plurality of retainer segments including a retainer body and a retainer protrusion, wherein the retainer protrusion extends from the retainer body in a radial direction.

In some aspects, the techniques described herein relate to a plug system, further including a retainer ring to affix the retainer segments to the housing, wherein at least a portion of the retainer body is arranged between the housing and a portion of the retainer ring.

In some aspects, the techniques described herein relate to a plug system, wherein at least one of the plurality of retainer segments including a retainer body and a retainer protrusion, wherein the retainer protrusion extends from the retainer body in a radial direction.

In some aspects, the techniques described herein relate to a plug system, further including a retainer ring to affix the retainer segments to the housing, wherein at least a portion of the retainer body is arranged between the housing and a portion of the retainer ring.

BRIEF DESCRIPTION OF THE FIGURES

The above and further features of the invention are a set forth with particularity in the appended claims and advantages thereof will become clearer from consideration of the following detailed description. Embodiments of the present invention will now be described, by way of example only, with reference to the following diagrams wherein:

REFERENCE NUMBERS AND CORRESPONDING ELEMENTS

Figure 1:
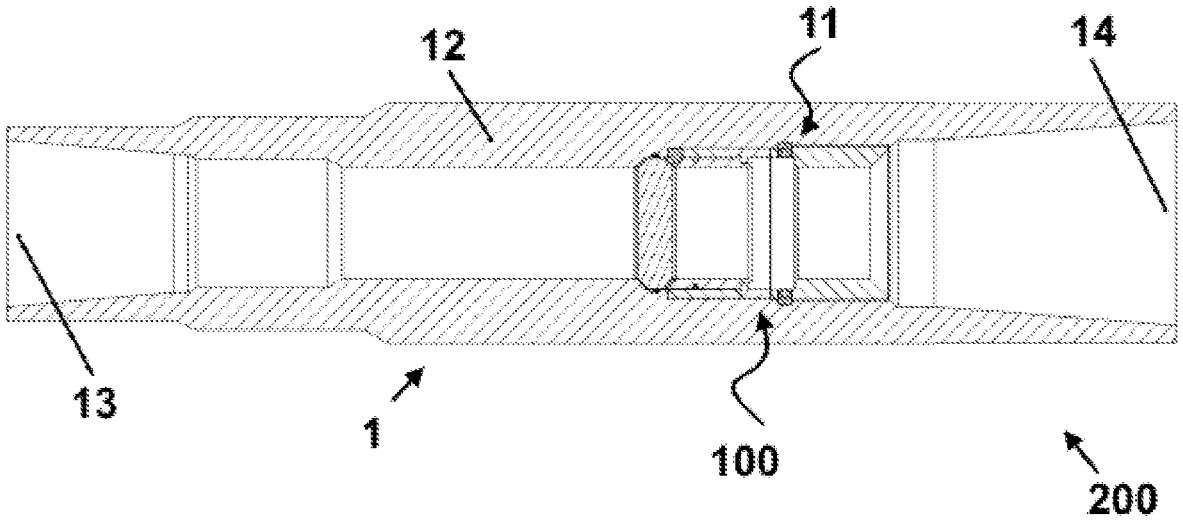
FIG. 1 discloses a cross sectional side view of a plug system

1 Plug Tubular
11 Housing
12 Tubular Body
13 Upstream Tubular Connection
14 Downstream Tubular Connection
15 First Tubular Section
16 Second Tubular Section
2 Plug
21 Sealing Element
22 Bearing Ring
3 Breaker Assembly
31 Breaker Support
32 Breaker Object
33 Snap Ring Pocket
4 Seat
41 Seat Body
42 Retaining Lip
43 Snap Ring
44 Breaker Pocket
45 Snap Ring Groove
5 Shear Ring
51 Shear Ring Body
52 Shear Ring Lip
6 Assembly Retainer
61 Retainer Body
62 Retainer Connector
63 Retainer Top
64 Retainer Dampener
65 Retainer Segments
66 Retainer Protrusions
67 Retainer Ring
100 Plug Assembly
200 Plug System

DETAILED DESCRIPTION OF THE INVENTION

Reference will now be made in detail to the present embodiments of the invention, examples of which are illustrated in the accompanying drawings. Alternative embodiments will also be presented. The drawings are intended to be read in conjunction with both the summary, the detailed description, and an any preferred and/or particular embodiments, specifically discussed or otherwise disclosed. This invention may, however, be embodied in many different forms and should not be construed as limited to the embodiments set forth herein. These embodiments are provided by way of illustration only. Several further embodiments, or combinations of the presented embodiments, will be within the scope of one skilled in the art.

The present invention is a plug assembly that is arranged in a tubular.

In the examples disclosed in FIGS. 1-7C, the plug assembly has three positions. In the first position, the plug rests on a seat and is intact and prevents fluid flow through the tubular. When a pressure differential is applied to the plug that exceeds a predetermined threshold, the plug and plug seat will move in an axial direction. By pressure differential is meant the differential between the pressure from downhole and uphole across the plug. Typically there is a pressure exerted by the fluids in the formation upwards, i.e. from downhole, while pressure is applied from uphole by pumping from the wellhead. Eventually the plug seat will enter the second position. In the second position, the plug makes contact with a breaker object. Contact with the breaker object will cause the plug to break. Note that the invention can be arranged such that it is the pressure from downhole that triggers the breaking of the plug, but it is more common with pressure from uphole being used for that purpose.

Then the plug assembly will move into a third position. In the third position the plug seat is locked in place by a snap ring. The snap ring is deigned to expand or contract. Being held in a position under tension, it will expand or contract when it is lined up with a groove or recess where it has space to move into. The snap ring prevents the plug seat from moving in the axial direction. The second and third position can occur at the same time. Note that reference to the plug system being in the first, second, or third position is the same as the plug assembly being in the first, second, or third position (and vice versa).

Direction terms such as up, down, left, right, above, below, etc. are being used in reference to the orientation of the elements in the figures. In no way is this intended as limiting.

Reference is made to FIG. 1. FIG. 1 discloses a cross sectional side view of a plug system 200. The plug system 200 comprises a plug tubular 1 and a plug assembly 100. The plug tubular 1 comprises tubular body 12 with a through bore. The through bore has an upstream tubular connection 13 end and a downstream tubular connection 14 on the opposing end. There is a plug assembly 100 arranged between the upstream tubular connection 13 and the downstream tubular connection 14. The position of the plug assembly 100 as shown blocks the fluid connection through the plug tubular 1. The plug assembly 100 shown is arranged in a housing 11. The housing 11 is arranged in the tubular body 12. In the figures shown, the housing 11 is the portion of the tubular body 12 which has been shaped in order to accommodate the plug assembly 100. However, it can also be a separate element.

The tubular body 12 shown in the figure is of one continuous piece. The single continuous piece provides a more rigid, and stronger, plug tubular 1. Additionally, it does not require any welds or seals that are required when joining two pipe sections together which enclose the plug assembly 100. These welds or seals can become areas where fluid can leak out from the tubular itself; particularly under high pressure/temperature environments.

It is possible for the housing 11 to be arranged in an element between the tubular body 12 and the plug assembly 100. The tubular body 12 need not be in one continuous piece as will be discussed in FIGS. 5A-5B.

Figure 2A:
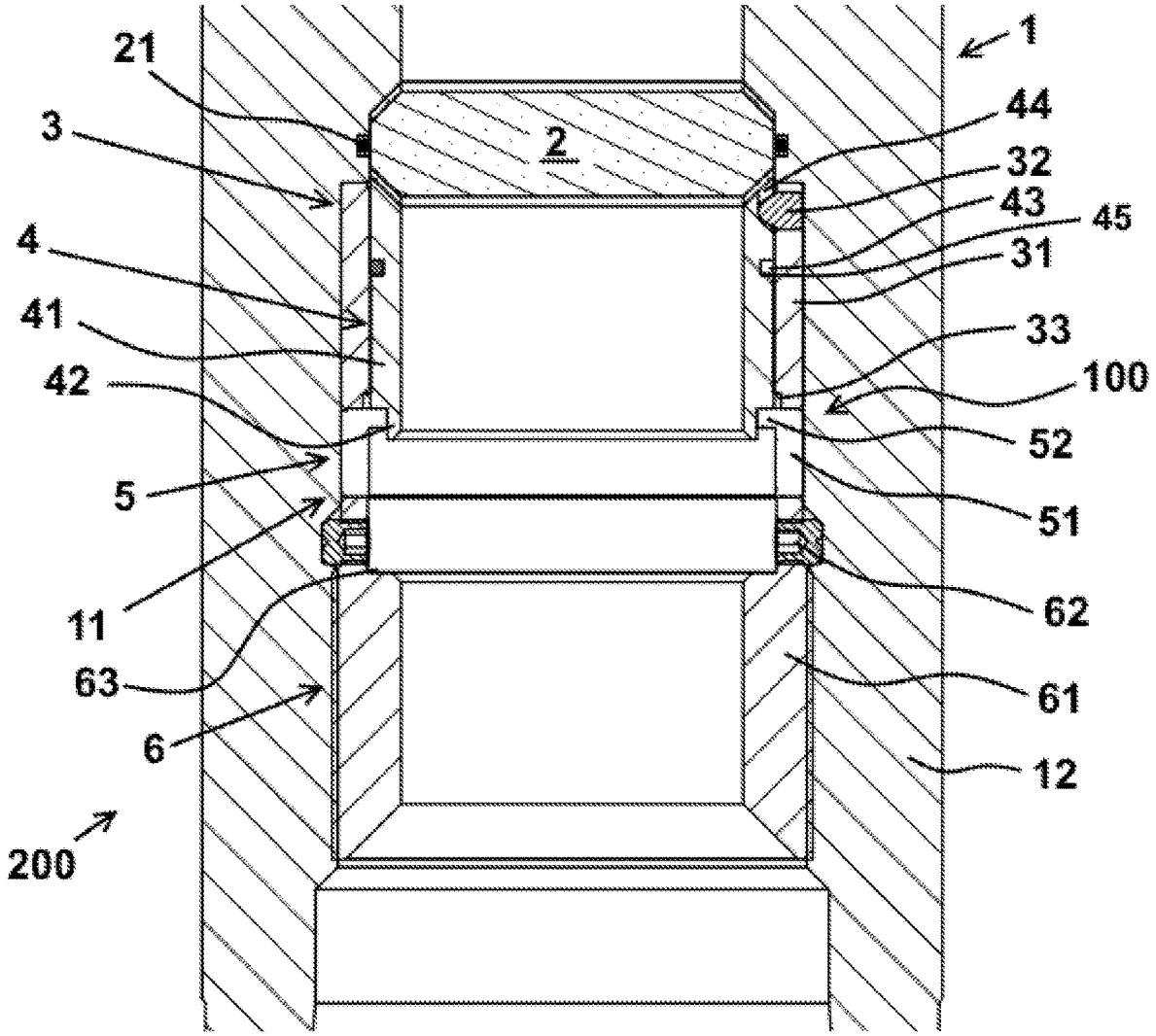
FIG. 2A discloses a closeup cross sectional view of the plug assembly in a first position FIG. 2B discloses a closeup cross sectional view of the plug assembly in a second position FIG. 2C discloses a closeup cross sectional view of the plug assembly in a third position FIGS. 3A and 3B disclose an embodiment of the plug system of the components of a plug tubular and a plug assembly in an exploded view.

Reference is made to FIG. 2A. FIG. 2A discloses a closeup cross sectional view of the plug assembly 100 in a first position. The uphole side is on the top of the figure and the downhole side is on the bottom of the figure. The plug system 200 comprises a plug assembly 100 arranged in a plug tubular 1. The plug tubular 1 comprises a tubular body 12. The housing 11 is arranged in the tubular body 12.

A plug 2 is supported by a seat 4. A shear ring 5 is arranged to provide support to the seat 4. The shear ring comprises a shear ring body 51 and a shear ring lip 52. It is the shear ring lip 52 that is shown to support the seat 4 in the figure. The shear ring 5 is designed to shear (break) at the area between the shear ring lip 52 and the shear ring body 51. This causes the seat 4 and the plug 2 to travel downwards in an axial direction.

Between the seat 4 and the plug 2 is arranged a bearing ring 22. This bearing ring 22 helps to hold the plug 2 in place under high pressure. A bearing ring 22 can also be arranged on top of the plug 2. (Please note that the bearing rings 22 are not labelled on FIGS. 2A-C but are labelled in FIG. 3B). Bearing rings 22 helps hold the plug 2 in place under high pressure. If the pressure is higher from downhole than uphole, the plug 2 will be pressed against the bearing ring 22 located uphole of the plug 2, while if the pressure is higher from uphole than downhole, the plug 2 will be pressed against the bearing ring 22 located downhole of plug 2. There is a sealing element 21 between the plug 2 and the housing 11. The purpose of the sealing element 21 is to help maintain the fluid seal of the plug 2. It is preferred that the plug 2 is fluid tight between the first and second positions. Thus, it is preferred that the plug 2 is in sealing engagement with the sealing element 21 in both the first and second positions. This also prevents fluid from traveling around the plug 2 and causing it to twist or tilt. Also, if increasing the differential pressure to cause the plug 2 to be broken is happening slowly, and the plug 2 is not in sealing engagement the whole way traveling between first and second positions, this could lead to pressure bleed off and thus prevent a high enough differential pressure for breaking the plug 2.

The seat 4 comprises a seat body 41. In the figure, a snap ring 43 is arranged in a snap ring groove 45 in the seat body 41. Further, the seat has a breaker pocket 44 that allows for the breaker object 32 to pass through the seat during operation of the plug assembly 100. The snap ring is designed such that when the plug assembly 100 is in the third position, it will expand into a snap ring pocket 33 in the breaker assembly. In this way, the seat 4 will be prevented from moving uphole or downhole. In this embodiment, this prevention of any further movement of the seat 4 occurs because the seat 4 is locked to the breaker assembly 3 by the snap ring 43. As the breaker assembly 3 is fixed with respect to the tubular body 12, this also fixes the seat 4 with respect to the tubular body 12. The seat 4 further comprises a retaining lip 42. The purpose of the retaining lip 42 is to keep the shear ring lip 52 from moving in the axial position and/or radially when the plug assembly 100 is in the third position. It is preferable that the retaining lip 42 extends to at least the same distance as the thickness as the shear ring lip 52 in order to prevent the shear ring lip 52 from moving in a radial direction or twisting as the plug 2 moves axially. In this way, the chances of the shear ring lip 52 accidently entering the wellbore is greatly reduced because it cannot freely move in an unwanted direction during operation of the plug assembly 100.

In the first position, as shown in FIG. 2A, the breaker object 32 is not in contact with the plug 2. The breaker object 32 can be a stud, knife, or other object that is suitable for breaking the plug 2. The breaker object 32 is held in place by the breaker support 31. The breaker 3 further comprises a snap ring pocket 33. The purpose of the snap ring pocket 33 is to give the snap ring 43 space to expand into when in the third position.

The plug assembly 100 further comprises an assembly retainer 6. The assembly retainer 6 is fixed with respect to the tubular body 12. This allows the assembly retainer 6 to provide support to one or more elements in the plug assembly 100. In FIG. 2A, it provides direct support to the shear ring body 51 (and through the shear ring body 51, indirect support to the breaker support 31). The assembly retainer 6 is fixed to the tubular body 12 by a retainer connector 62 arranged in the retainer body 61. The retainer connector 62 shown uses screws to affix the assembly retainer 6 to the housing 11 in the tubular body 12. Other options could include to use a dowel pin that is glued rather than screwed or using threads on the outside of the retainer connector 62 to screw into the housing 11. Threads could also be arranged on the outside of the retainer 6 itself (for example on the retainer body 61). Note that the retainer 6 could also be fixed to something that remains stationary with respect to the tubular body 12.

The retainer top 63 is an area on top of the assembly retainer 6. In the third position, this is where the distal end of the retaining lip 42 contacts the assembly retainer 6. This helps prevent the shear ring lip 52 from moving axially and/or radially and entering the through bore of the plug tubular.

An assembly retainer 6 can also be affixed to an element that is stationary with respect to the seat 4 when the plug assembly 100 moves from the second to the third position. For example, the tubular body 12 or an element that is supported by a protrusion from the tubular body 12, affixed to the tubular body 12, or supported indirectly by an element that is stationary with respect to the tubular body 12.

The plug 2 is shown on the uphole side of the plug assembly 100. However, it is also possible for the plug 2 to be on the downhole side of the plug assembly 100. This would allow for the plug assembly 100 to be operated such that it is pressure from the downhole side that breaks the shear ring 5.

The seat is shown as supported by the shear ring lip 52, however it is also possible for the breaker assembly 3 to be supported by the shear ring lip 52. This can be useful if the breaker object 32 itself moves to make contact with the plug 2 and not the seat.

The figures show that the snap ring 43 is arranged in a snap ring groove 45 in the seat body 41. However, the snap ring 43 could also be arranged in the breaker support 31. In both cases, the snap ring 43 would still prevent the seat 4 from moving in the axial direction in the third position. Further, the snap ring 43 could be arranged such that it expands (or contracts) into a groove in the tubular body 12 or other element that is stationary with respect to the tubular body 12.

The retaining lip 42 is shown as a groove at the end of the seat body 41. However, the retaining lip 42 could be at another location of the seat 4. What is important is that the retaining lip 42 fits around the shear ring lip 52 and prevents the shear ring lip 52 from moving axially when the plug assembly 100 is in the third position. Preferably the retaining lip 42 also prevents movement of the shear ring lip 52 in the radial direction as well. An advantage of not having the groove of the retaining lip 42, but along the seat body 41 is that the shear ring lip 52 can be enclosed on both sides. This would help to keep the shear ring lip 52 in place when in the third position.

Note that while the snap ring pocket 33 is show at the end of the breaker support 31, this is not required. The snap ring pocket 33 can be arranged anywhere along the breaker support 31 provided that the seat 4 can move far enough such that the plug 2 breaks before or simultaneously with the plug assembly 100 entering in the third position.

While it is preferable that the shear ring lip 52 be held in place as the seat 4 moves axially by the retaining lip 42, this is not essential.

In the case that the plug assembly 100 was inverted so that the plug 2 was on the downhole side of the plug assembly 100, the assembly retainer 6 could either remain on the downhole side or be moved to the uphole side. This would depend on precisely which elements needed the axial support provided by the assembly retainer 6.

Figure 5A:
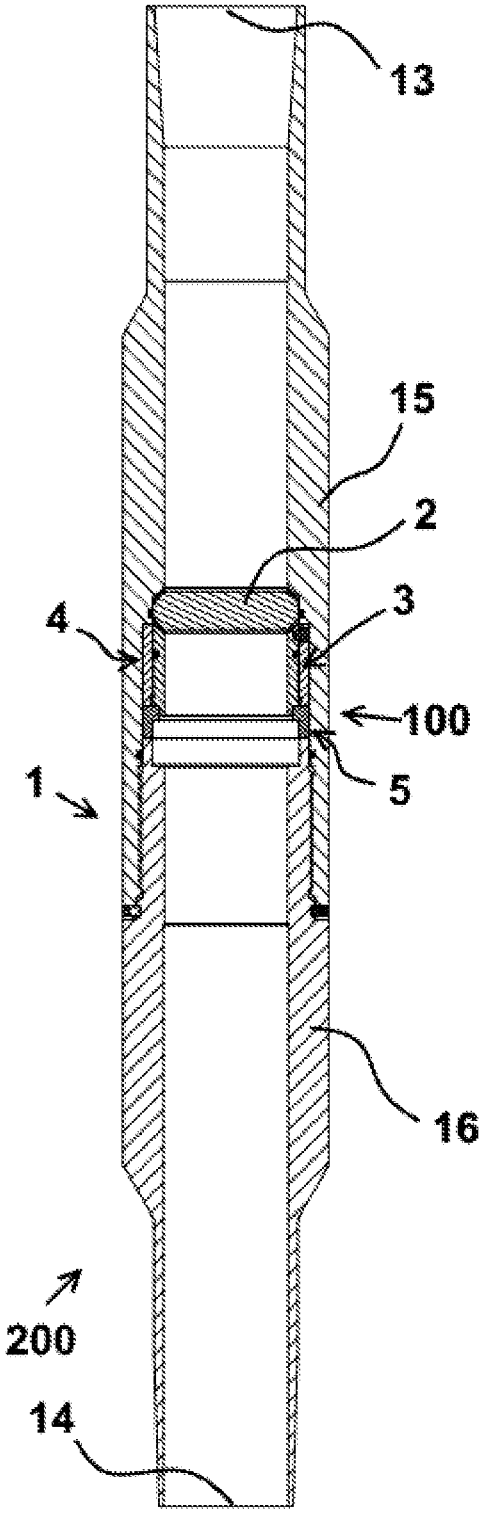
Figure 5B:
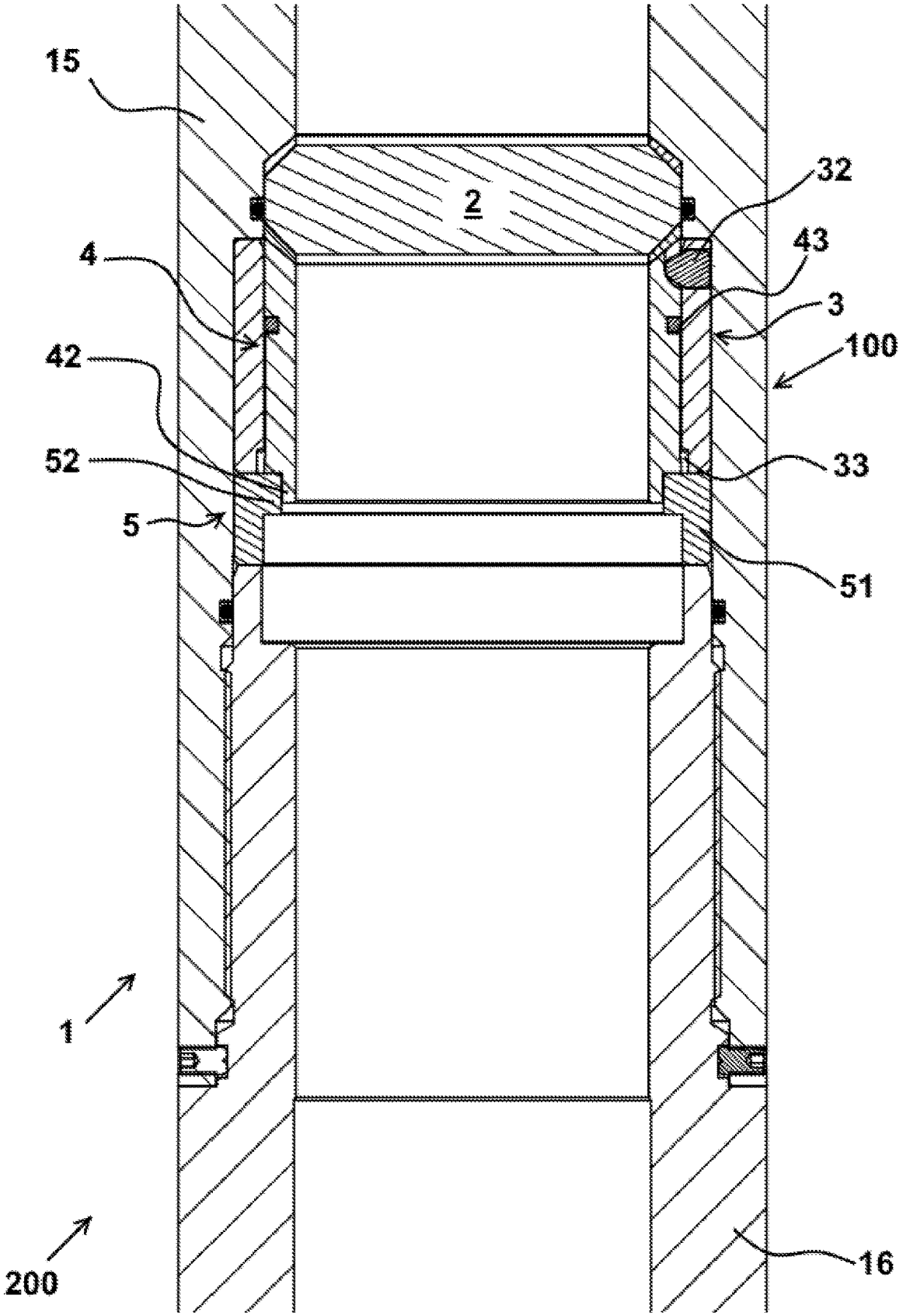

Note that as will be seen in FIGS. 5A-5B, the assembly retainer 6 is not essential. In this case, the shear ring 5 is supported by the first tubular section 15. Another example of where the assembly retainer 6 is not essential is if the shear ring 5 was supported by a protrusion from the tubular body 12.

Figure 2B:
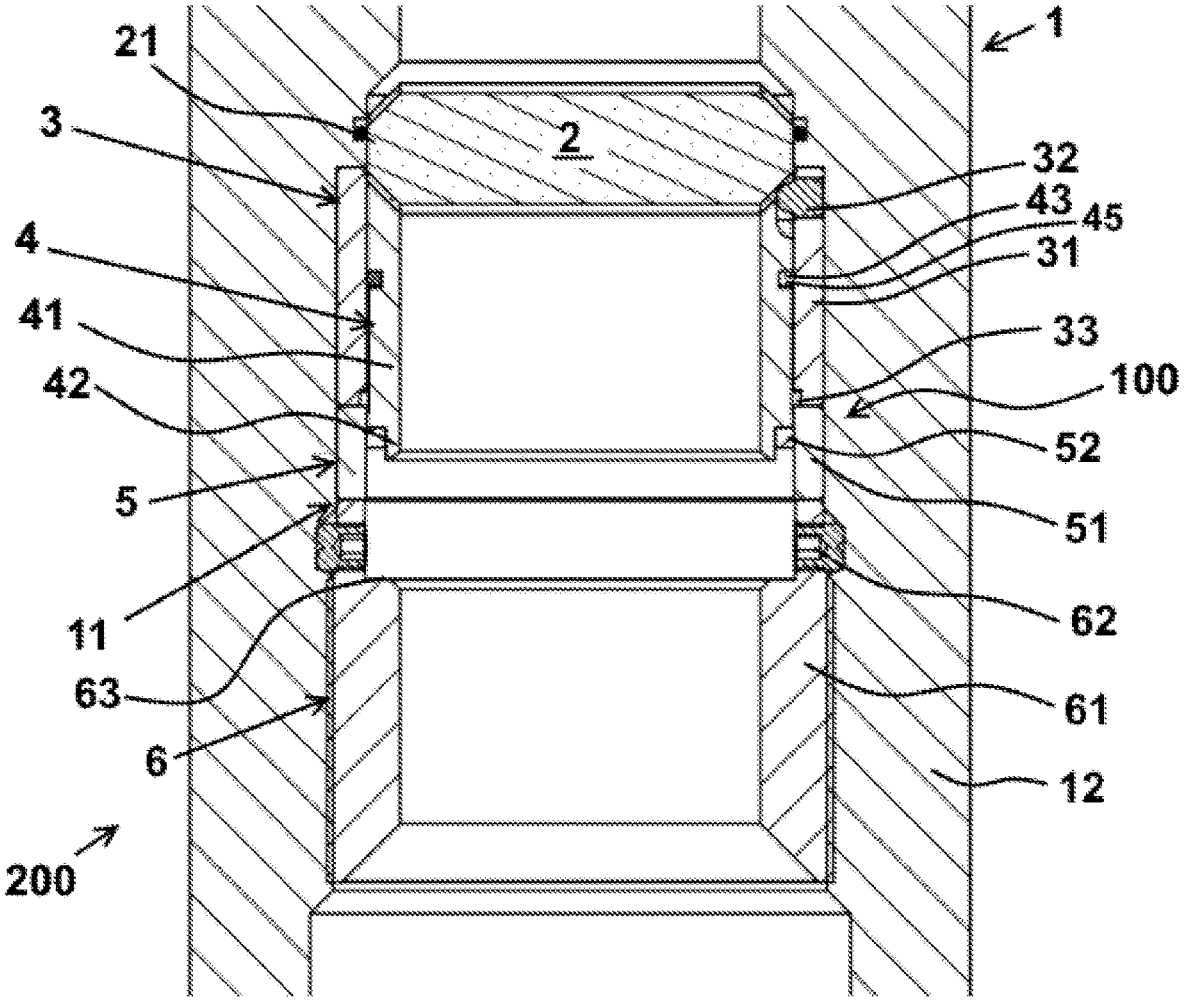

Reference is made to FIG. 2B. FIG. 2B discloses a closeup cross sectional view of the plug assembly 100 in a second position. As the plug assembly 100 (and thus the plug system 200) has moved from the first position to the second position, the plug 2 is in contact with breaker object 32. This will initiate the process that will result in the plug 2 breaking and fluid flow through the plug tubular 1 being restored.

As seen in FIG. 2B, the shear ring body 51 and the shear ring lip 52 have sheared. As the seat was supported by the shear ring body 51, it is now free to move axially downwards. The shear ring lip 52 is prevented from moving radially into the wellbore by the retaining lip 42. The shear ring body 51 is being supported by the assembly retainer 6. The snap ring 43 is arranged in the snap ring groove 45.

Figure 2C:
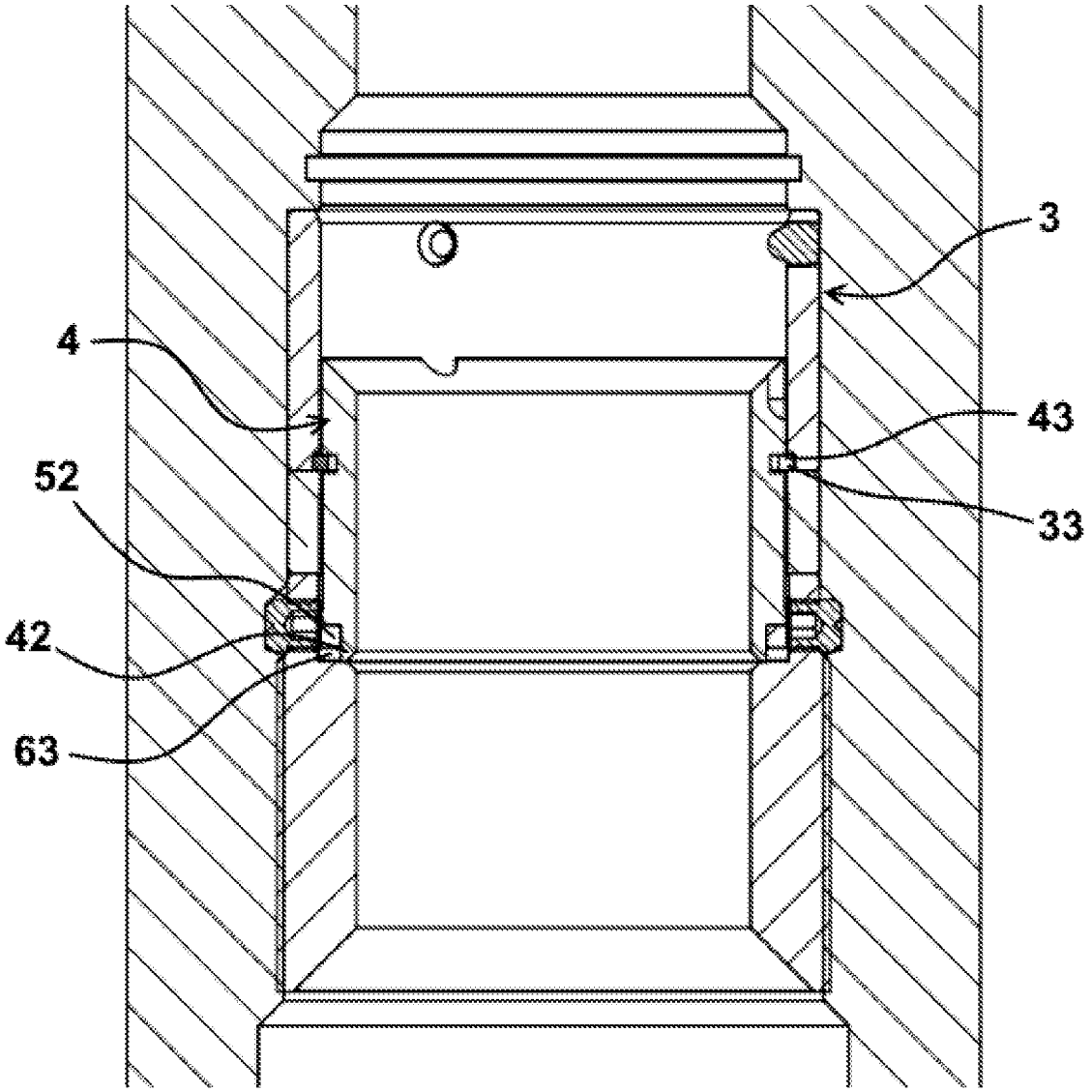

Reference is made to FIG. 2C. FIG. 2C discloses a closeup cross sectional view of the plug assembly in a third position. As shown in FIG. 2C, the plug 2 has broken (and is not seen in the figure) due to contact with the breaker object 32. The seat 4 will continue to travel in an axial direction until the snap ring 43 lines up with the snap ring pocket 33. At that point, the snap ring 43 will expand into the snap ring pocket 33. This will prevent the seat 4 from moving in an axial direction again. Additionally, the shear ring lip 52 will be trapped between the retaining lip 42 and the retainer top 63. This will further prevent the shear ring lip 52 from escaping into the wellbore through axial or radial movement.

In normal operation, the third position will be after the plug 2 has been broken by the breaker object 32. However, it is possible for the second position and the third position to occur at the same time. In other words, the snap ring 43 could be arranged in such a way that it locked the seat 4 and the breaker 3 together when the plug 2 makes contact with the breaker object 32.

Figure 3A:
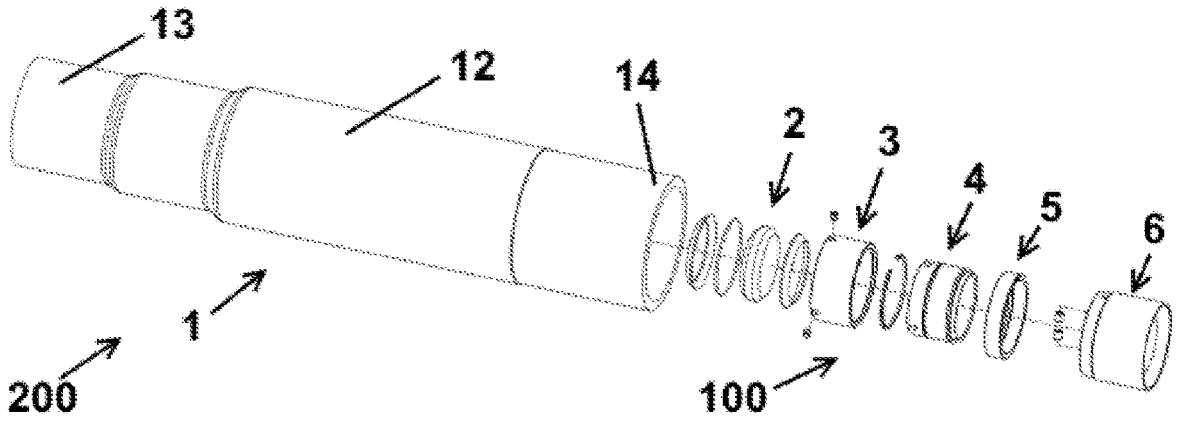
Figure 3B:
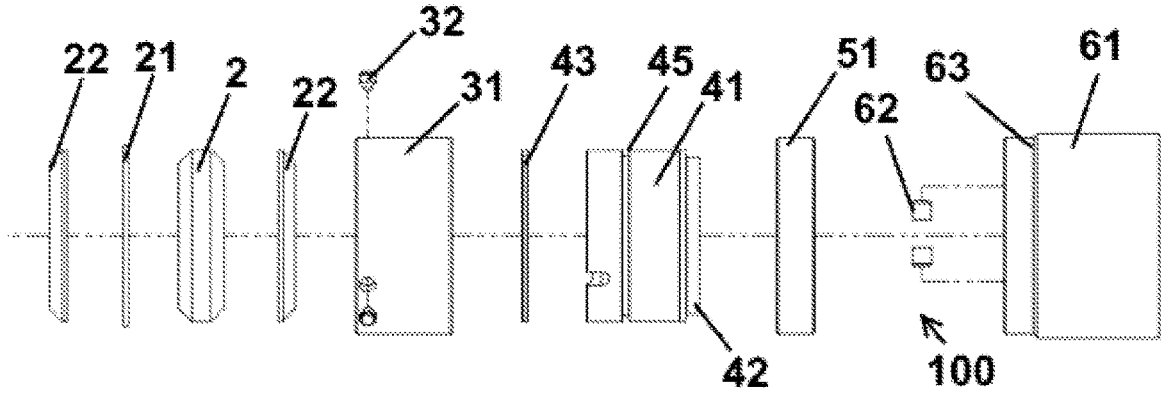

Reference is made to FIGS. 3A and 3B. FIGS. 3A and 3B disclose an embodiment of the plug system 200 of a plug tubular 1 and a plug assembly 100, shown in an exploded view and side view, respectively. The plug tubular 1 comprises a tubular body 12 and openings upstream tubular connection 13 and downstream tubular connection 14. These are where other tubulars would be attached. Note that the tubular body 12 is made of a continuous piece in this figure. The plug assembly 100 is arranged inside of the plug tubular 1 and comprises a plug 2, a breaker assembly 3, a seat 4, a shear ring 5, and an assembly retainer 6. The plug 2 rests upon the seat 4. The seat 4 is shown as arranged at least partially inside of the breaker assembly 3. The seat 4 is supported by a portion of the shear ring 5. The shear ring is supported by the assembly retainer 6. In the embodiment shown the figure, a portion of the assembly retainer 6 is arranged within the shear ring 5.

A bearing ring 22 is arranged between the seat 4 and the plug 2. On the opposite side of the plug 2, a sealing element 21 is arranged between the plug 2 and a second bearing ring 22. The breaker 3 is comprised of one or more breaker object 32 and a breaker support 31. The seat 4 comprises a seat body 41. A snap ring 43 is arranged in a snap ring groove 45. A retaining lip 42 protrudes from the seat body 41. The purpose of the snap ring is to lock the seat 4 in place in the third position. The retaining lip 42 keeps the shear ring lip 52 (not shown) from entering the wellbore when moving from the first position to the third position. The shear ring 5 comprises a shear ring body 51 and a shear ring lip 52 (not shown). The shear ring lip 52 is the portion of the shear ring 5, that supports the seat 4. The shear ring body 51 is supported by the assembly retainer 6. The retainer top 63 is a groove in the top of the retainer body 61. The retainer is affixed to the housing 11 in the tubular body 12 through the retainer connector 62. In these figures it is affixed by screws and by threads, where said threads matches threads in the tubular body 12 of the plug tubular 1 and screws into it. During assembly the screws are screwed partially into the tubular body 12, the retainer body 61 is then inserted into the tubular body 12 by screwing the retainer body 61 into the tubular body, and the screws are then screwed all the way into the tubular body 12.

Note that while the plug assembly 100 which is inserted into the plug tubular 1 is shown in all of the figures as comprising a snap ring 43 and an assembly retainer 6, these elements are not necessary. Plug assemblies 100 without one or both elements could also be inserted into the plug tubular 1.

Since FIGS. 3A and 3B is shown in an exploded view, these figures show an example of a method for assembling a plug system 200 when the tubular body is a single continuous piece. The plug assembly 100 is inserted into the housing 11 in the plug tubular 1, then an assembly retainer 6 is inserted into the housing 11 and affixed thereto, resulting in the assembly retainer 6 supporting the plug assembly.

Preferably the plug 2 is inserted into the tubular body 1 first. Then the breaker assembly 3 and seat 4 and shear ring 5 is fit together, with the seat 4 on the inside of the breaker assembly 3 and the shear ring 5 on the downhole side of the seat 4 and breaker assembly 3. Then the assembled breaker assembly 3, seat 4, and shear ring 5 is inserted together into the tubular body 1. Alternatively, the plug 2 is first inserted into the tubular body 1, followed by the breaker assembly 3 and then the seat 4 is inserted into the breaker assembly 3, and finally the shear ring 5 is installed into the tubular body 1. Either way the plug 2 will be arranged on top of the seat 4, and the seat 4 at least partially inside the breaker assembly 3. Since the shear ring 5 is inserted last, the other components rest on it, and thus pressure from upstream will be conveyed through the plug 2 onto the seat 4 to the shear ring 5, and when the shear ring 5 breaks due to said pressure the seat 4 will be freed to move downwards. In some examples the breaker assembly 3 could be inserted into the seat 4 instead of the other way around.

By using an assembly retainer 6, it is possible for the plug assembly 100 to be supported without the seat 4 and/or breaker assembly 3 and/or shear ring 5 resting upon a second tubular section 16. One effect of this is that a manufacturer does not need to create protrusions from the inner diameter of the tubular body 12 in order to give the plug assembly 100 a place to rest upon.

In another example, the plug assembly 100 could be supported and affixed to the housing 11 though an attachment of the shear ring body 51 to the housing 11. One way of doing this would be to use a two part shear ring 5 where the shear ring body 51 was of a strong enough material to support the plug assembly 100 during operation, and using shear pins between the shear ring body 51 and the shear ring lip 52. Another way to accomplish this is to support the shear ring 5 (or the assembly retainer 6) with a protrusion from the tubular body 12.

Figure 4A:
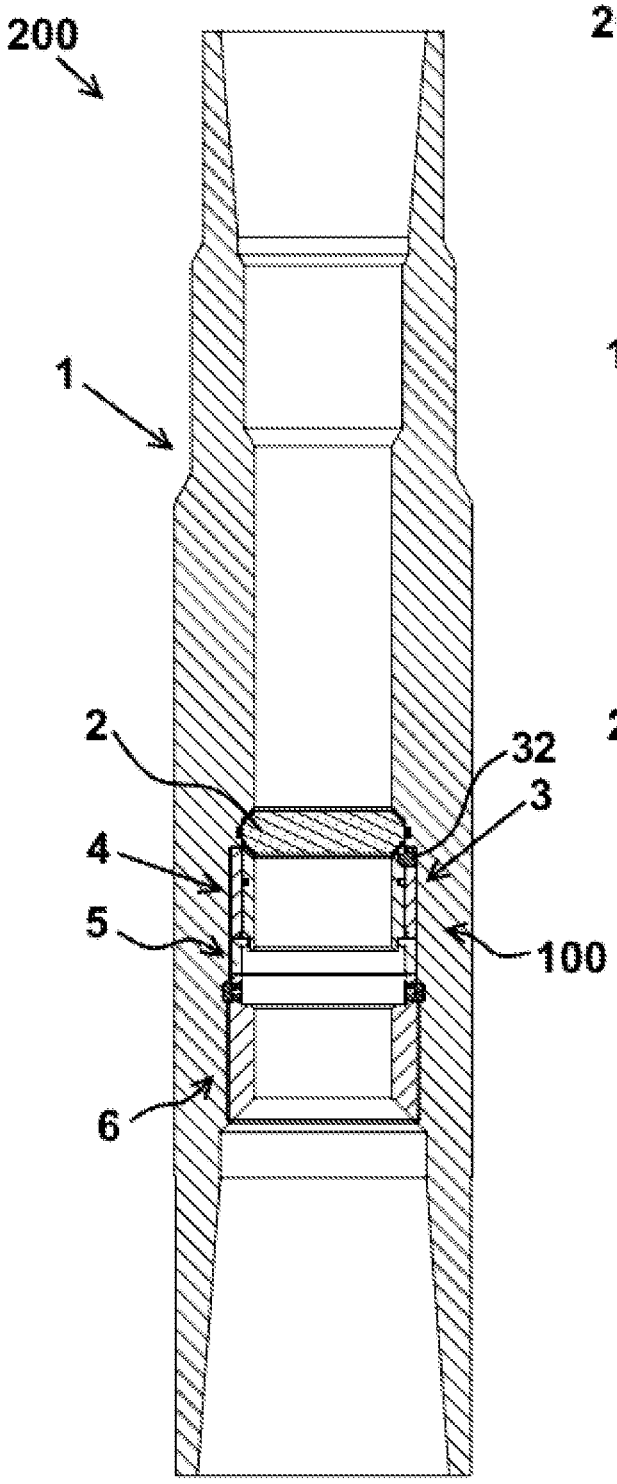
FIGS. 4A-4D disclose the plug system as it moves from a first to a third position FIGS. 5A and 5B disclose an embodiment of the plug system and plug assembly where the plug tubular is made of two different tubular sections.

Reference is made to FIGS. 4A-4D. FIGS. 4A-4D disclose the plug system 200 as it moves from a first to a third position. The plug system 200 is comprised of a plug assembly 100 arranged in a plug tubular 1. In the first position, as shown in FIG. 4A, the plug 2 is not in contact with the breaker object 32 of the breaker 3. The plug 2 is supported by the seat 4. The seat 4 is supported by the shear ring 5 is supported by the assembly retainer 6.

Figure 4B:
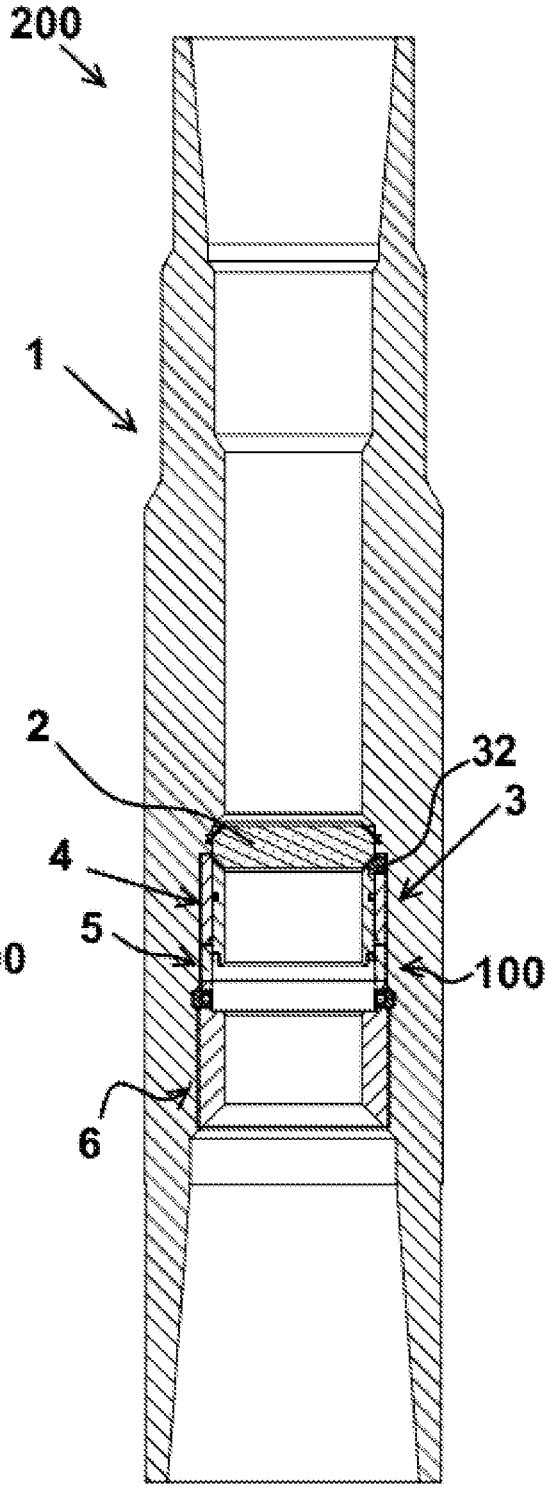

To move the plug system 200 into the second position, as shown in FIG. 4B, where the plug 2 is in contact with the breaker object 32, a predetermined threshold differential pressure is applied to the plug 2. This causes the shear ring 5 to shear. As the portion of the shear ring 5 provided support to the seat 4, the seat 4 will now lack support. The seat 4 will then move in an axial direction. This will bring the plug 2 into contact with the breaker object 32 of the breaker 3. Note that the shear ring 5 could be set to shear at a predetermined absolute pressure applied to the plug 2.

Figure 4C:
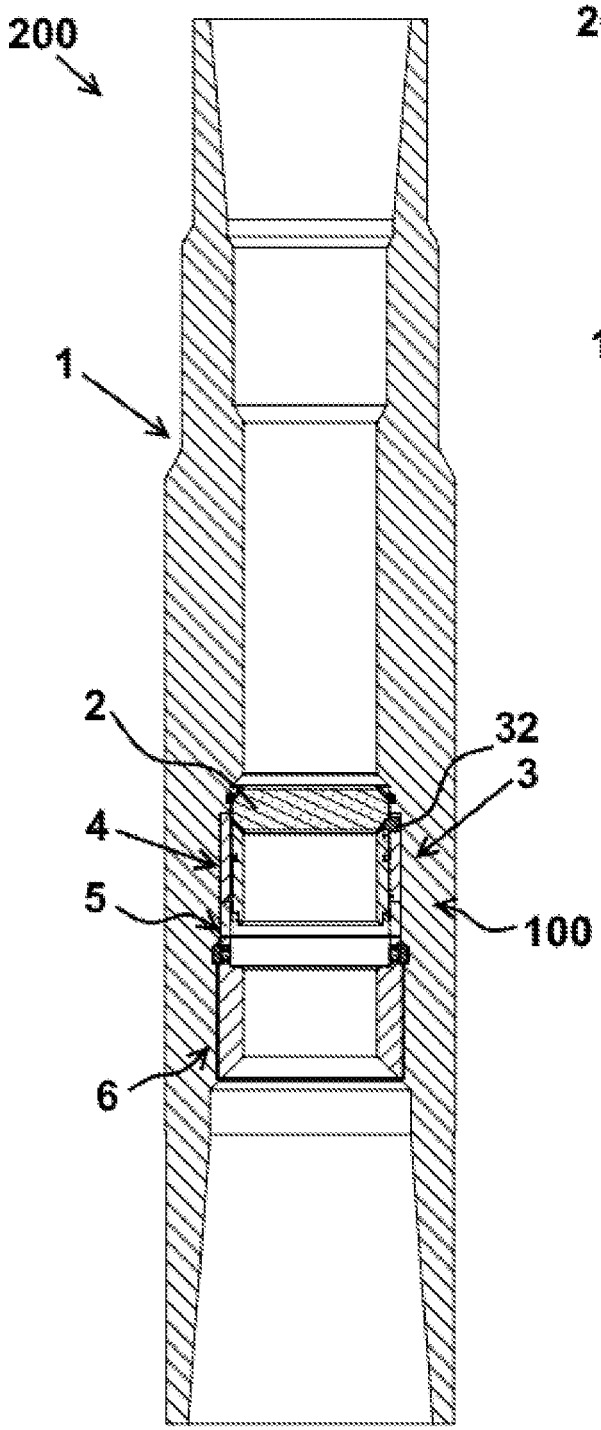

FIG. 4C shows an intermediate state between the second and third positions. The plug 2 has not broken yet and the breaker object 32 is now being forced further into the edge of the plug 2.

Figure 4D:
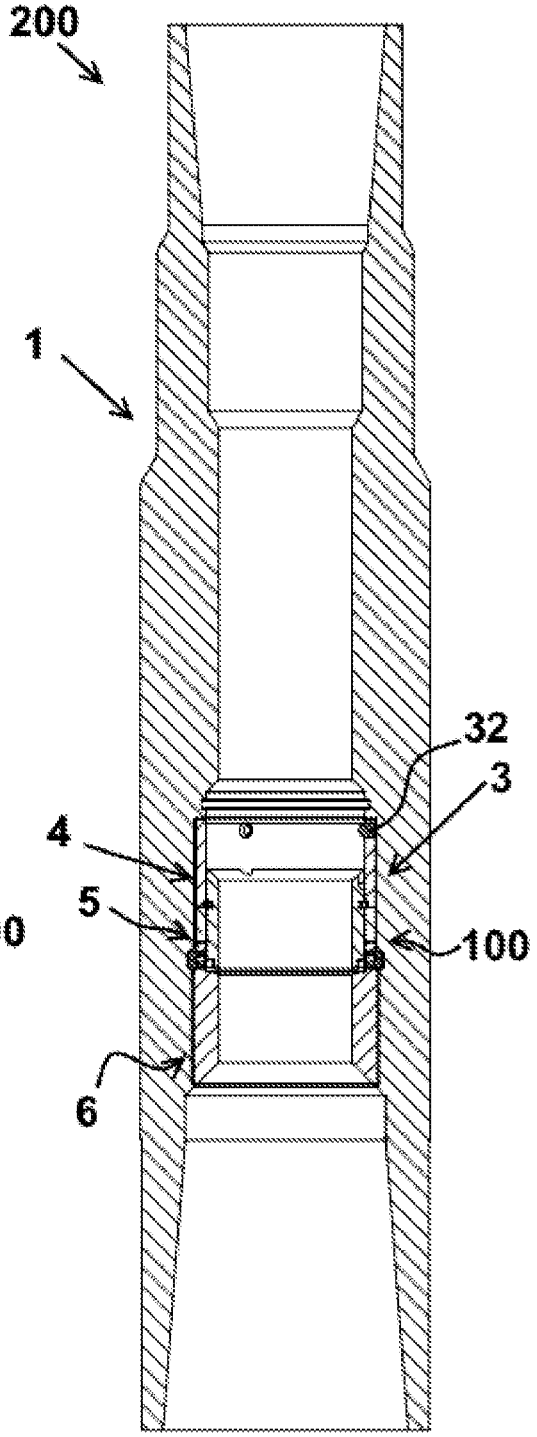

FIG. 4D shows the third position. The plug 2 has broken and the snap ring 43 (not shown) in the seat 4 locks into a groove in the breaker assembly 3. This prevents the seat 4 from moving axially (either uphole or downhole).

Reference is made to FIGS. 5A and 5B. FIGS. 5A and 5B disclose an embodiment of the plug system 200 where the plug tubular 1 is made of two different tubular sections. In FIGS. 1-4D, the plug tubular 1 is comprised of a tubular body 12 that is a continuous piece. In this alternative, the plug tubular 1 is comprised of a first tubular section 15 and a second tubular section 16 rather than a single piece. The upstream tubular connection 13 is at one end of the first tubular section 15 and the downstream tubular connection 14 as at the end of the second tubular section 16.

This example has almost the same plug assembly 100 as the previous examples. However, in this example an assembly retainer is not present. The plug 2 rests upon the seat 4. The seat 4 is supported by the shear ring 5 (in particular, the shear ring lip 52). A breaker assembly 3 is arranged to break the plug 2 in the second position (when the plug first contacts the breaker object 32), between the second position and the third position, or in the third position.

In previous examples, the shear ring body 51 of the shear ring 5 was supported by the assembly retainer 6 (not shown). In this example, the shear ring body 51 is supported by the top of the second tubular section 16.

As in previous examples, the retaining lip 42 is arranged such that the shear ring lip 52 cannot enter the wellbore through axial or radial movement. However, rather than the retaining lip 42 making contact with the retainer top 63 (not shown), it makes contact with the second tubular section 16.

Note that it is possible to have a plug tubular 1 that has a first tubular section 15 and a second tubular section 16 which still using an assembly retainer 6. The assembly retainer 6 could, for example, be attached to the tubular body 12 of either the first tubular section 15 or second tubular section 16. Another example is that the assembly retainer 6 could rest on top of the second tubular section 16. In the event that the plug assembly 100 is inverted with respect to the figures, the assembly retainer 6 may be in contact with the first tubular section 15 instead of the second tubular section 16 as shown.

The snap ring 43 is arranged to lock the seat 4 in place when the plug assembly 100 moves into the third position. This occurs when the snap ring 43 arranged in the seat enters the snap ring pocket 33 in the breaker assembly 3.

Figure 6:
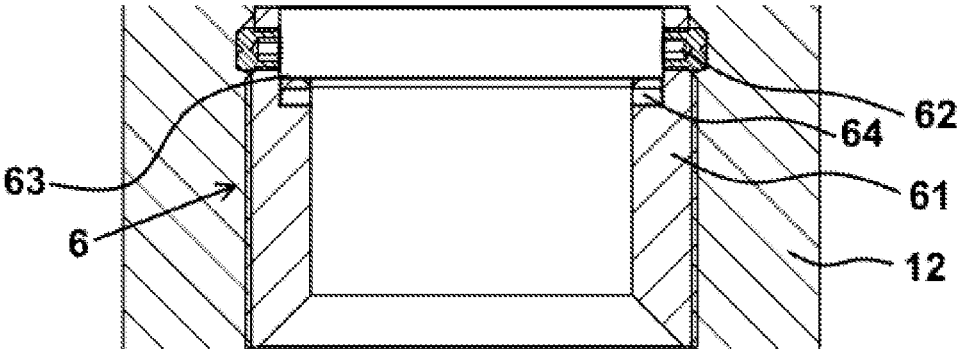
FIG. 6 discloses an embodiment of the retainer with a retainer dampener

Reference is made to FIG. 6. FIG. 6 discloses an embodiment of the retainer 6 with a retainer dampener 64. The assembly retainer 6 can also further comprise a retainer dampener 64. This is a dampening mechanism that would provide shock absorption when the plug assembly 100 is moving from a first position to the second and third positions. If there is a high differential pressure, the seat 4 could be moving with a considerable amount of speed and force. It is conceivable that if the force was high enough, the impact could make it difficult for the snap ring 43 to lock into place and not break. Another possible issue with high force movement is that components of the plug assembly 100 (e.g. seat 4) could dislodge the assembly retainer 6 itself. A retainer dampener 64 will absorb some of this force and help protect failure of the plug assembly 100 components. This could be accomplished by making a portion of the retainer top in a shock absorbing material (such as rubber). Another way that this could be accomplished is to make a portion of the retainer top moveable, but in a dampened fashion. For example, using mechanical springs, fluid springs (such as chambers of oil), pistons, or sealed chambers.

Figure 7A:
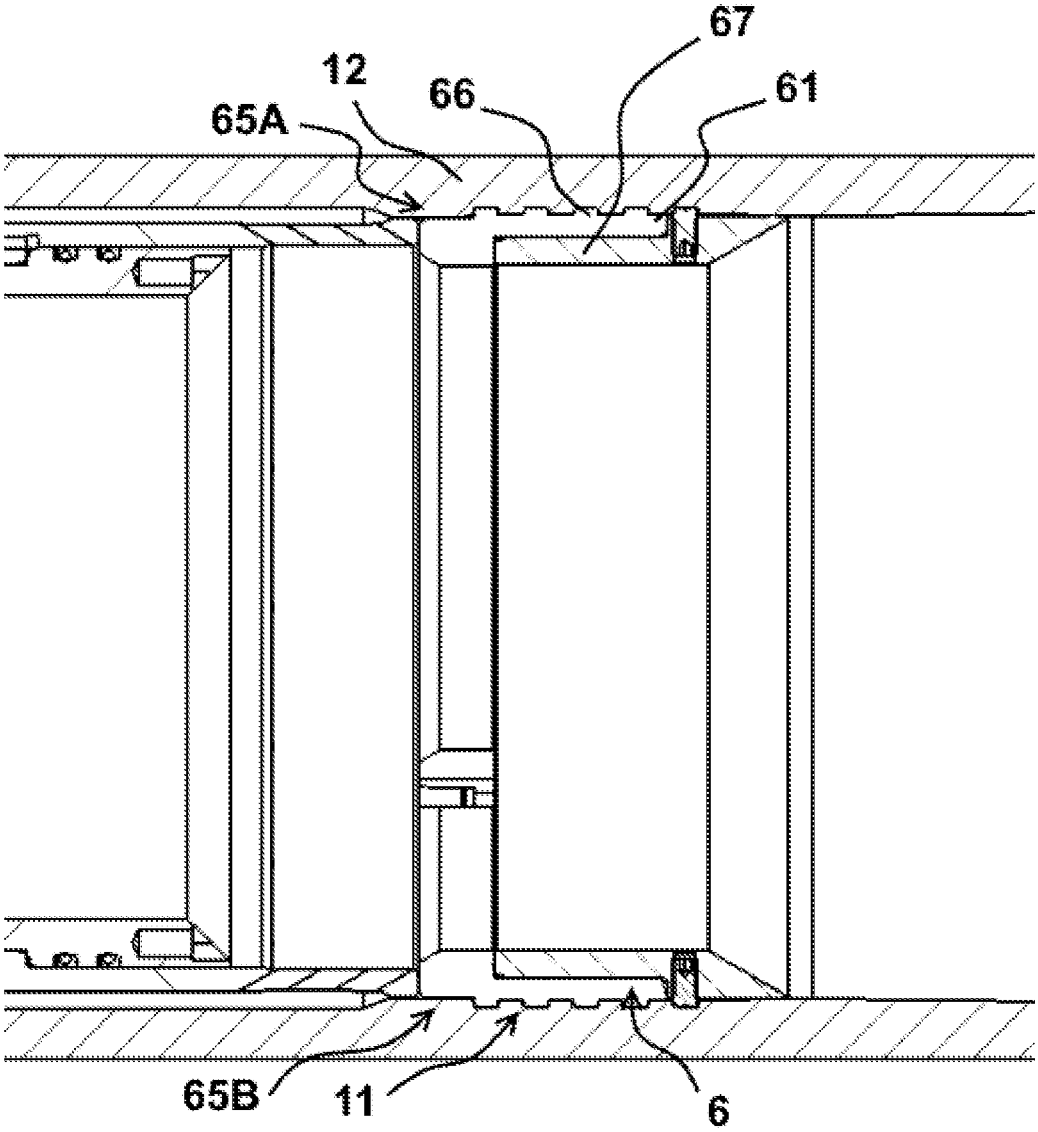
FIG. 7A-7C disclose an embodiment of the retainer in segments
Figure 7B:
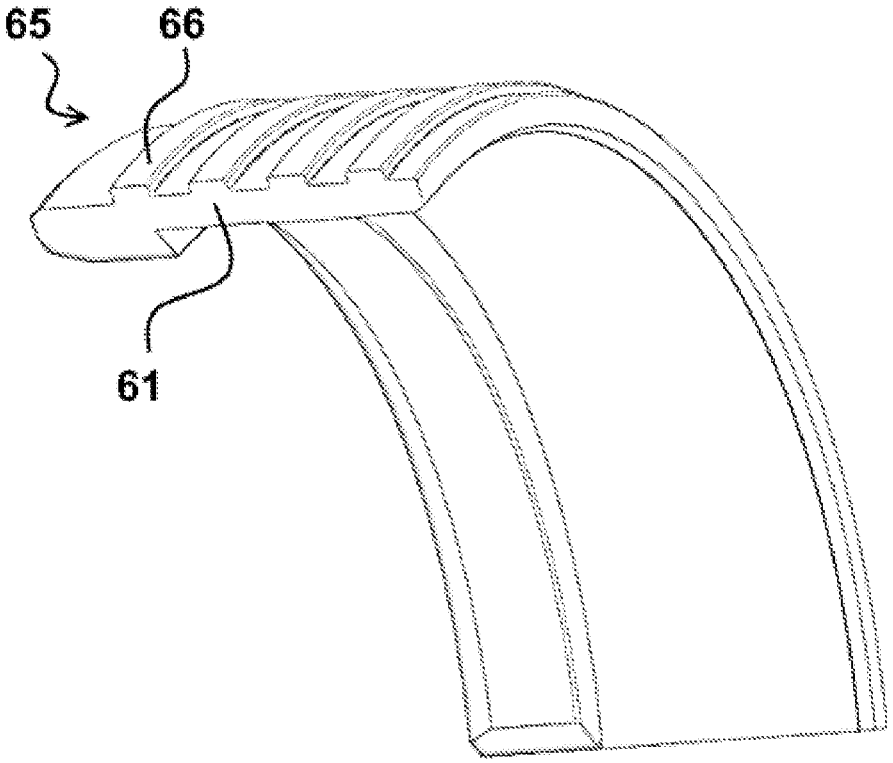
Figure 7C:
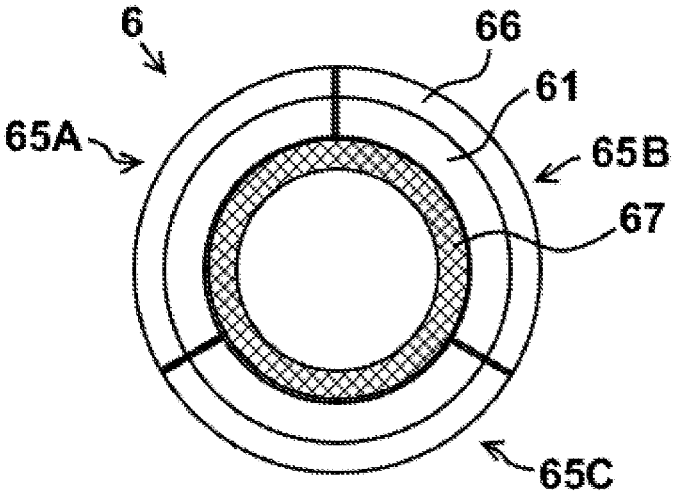

Reference is made to FIGS. 7A-7C. FIGS. 7A-7C disclose an embodiment of the assembly retainer 6 that is comprised of retainer segments 65. The retainer segments 65 allow for the assembly retainer 6 to be inserted as separate parts and then secured. The retainer segments 65 in FIG. 7A show retainer protrusions 66 in the radial direction from the retainer body 61. The retainer protrusions 66 allow for the tubular body 12 to provide support to the retainer segments 65. In the specific case in FIG. 7A, there are two segments 65A,65B. These retainer segments 65 are held in place by a retainer ring 67. The retainer ring 67 affixed directly or indirectly to the tubular body 12. The retainer protrusions 66 fit in matching grooves in the housing 11 in the tubular body 12.

FIG. 7B discloses one of the retainer segments 65 in a perspective view. As discussed above, there are retainer protrusions 66 which extend outwards in a radial direction from the retainer body 61.

FIG. 7C discloses an assembly retainer 6 with three retainer segments 65A,65B,65C. Rather than using a retainer ring 67, the retainer segments 65 could be affixed directly to the tubular body 12 itself. Note that the retainer segments shown in FIGS. 7A-7C, have a protrusion that extends into the center of the plug tubular 1. While this is not required for the functioning of this embodiment of the assembly retainer 6, it allows for easier alignment of the retainer ring 67 during assembly. Also, this allows for the retainer ring 67 to provide more support to the assembly retainer 6.

FIG. 7C shows a top view of an assembly retainer 6 which comprises three retainer segments 65A,65B,65C. This is an illustrative example. There can be two or more retainer segments 65 used. Note also that the retainer segments 65 are shown as abutting each other to form a complete ring. There can be gaps between one or more of the retainer segments 65. This might be necessary to make assembly of the plug tubular 1 easier because there will be more room to get the retainer segments 65 into place. Note that three retainer segments 65 is the most preferable arrangement as this allows for the fewest retainer segments 65 to be installed without any gaps between them. This provides the best support with the least amount of individual pieces that must be manufactured and assembled.

The embodiment of the retainer segments 65 is shown with retainer protrusions 66. However, depending upon the required tolerances, or strength of support provided by retainer ring 67, it could be possible to not to have retainer protrusions 66 at all. The figures are shown with four retainer protrusions 67, but the number of retainer protrusions can be adjusted depending upon need.

The retainer ring 67 is shown as affixed to the tubular body 12 with a set screw. One skilled in the art would know of other ways to achieve such an affixing. Another option is to use a locking ring which could expand into a groove in the tubular body 12 to hold the retainer ring 67 into place. This could be a separate element or a part of the retainer ring 67.

In the figures shown, the housing 11 is a portion of the tubular body 12 that has been shaped (e.g.: milled or cast) to receive the plug assembly 100. In such a case, affixing to the housing 11 is the same as directly affixing to the tubular body 12. This is also true in the case where the housing 11 is a separate element and the retainer 6 is affixed to a portion of the housing 11 that is stationary with respect to the tubular body 12 when the plug assembly 100 is in the first or second position.

As discussed herein, the shear ring 5 usually has a shear ring body 51 and a shear ring lip 52. In the figures, this shear ring lip 52 is shown as thinner than the shear ring body 51. This does not have to be the case; it could be the same thickness or thicker than the shear ring body 51. The shear ring lip 52 also does not have to be located at the end of the shear ring body 51, forming an L-shape, but could be located anywhere along the shear ring body 51, and having any suitable shape. The shear ring lip 52 may optionally be divided into shear ring tabs. These tabs are portions where the shear ring lip 52 has been divided into multiple pieces. The shear ring 5 can be easily adjusted to a desired shear pressure by for example adjusting its material type, thickness, or number of shear tabs. The shear values are predictable and repeatable. Thus, the assembly can be pre-set to open at a set value by changing the shear ring 5 only. Instead of a shear ring 5, it is also possible to alternatively use shear pins in accordance with the present invention. Rather than having a ring shape they have a pin shape, and one may use 2 or more shear pins around the circumference of the plug seat 4, preventing it from moving in an axial direction just as a shear ring 5 would.

Preferably, the plug sealing element 21 is in contact with the housing 11. If the sealing element is between the housing 11 and the plug 12, the plug 12 and sealing element 21 effectively form a fluid tight seal in the housing 11. More preferably the sealing element 21 is an O-ring located around the circumference of the plug 2 sealing it against the inside of the tubular body 12 it is installed in, but other forms of seals may also be used.

The plug is preferably a frangible disc, which is more preferably made up of one or more layers of glass. Glass does not change or get damaged noticeably by the corrosive conditions nor high temperatures in a wellbore and has the advantage of being able to break into very small pieces. Different types of glass can be obtained with different strengths and thicknesses capable of withstanding the differential pressures the plug assembly may be subject to. In some instances, for example when a very strong and/or thick glass is desired, it may be preferable to use two or more layers of glass. Producing especially hardened glass that is very thick is not feasible, and several thinner layers can be stronger than one thick layer. The plug assembly 100 presented herein can be used with a glass pack made from a single glass layer or a plurality of stacked layers. The layers of glass can be stacked directly on top of each other, or with a thin film of cushioning material in-between, in order to ensure sufficient distribution of force in the event that the disc surfaces are not sufficiently flat.

The snap ring could be arranged in the first position either in the snap ring groove or a snap ring pocket in the breaker support, and then snap into the receiving snap ring pocket or snap ring groove when the assembly moves from the first position into the third position.

In an example, the shear ring further includes a shear ring body and a shear ring lip; wherein: the shear ring shears at an interface between the shear ring lip and the shear ring body; the seat further includes a retaining lip, wherein the retaining lip is arranged such that it prevents the shear ring lip from moving in an axial and/or radial direction in the third position. This prevents the sheared off and therefore not attached to the assembly shear ring lip from entering the wellbore.

The plug assembly should be supported, it should not just sit loosely in the tubular. Having an assembly retainer fulfills this need. This could instead be done by a crossover, i.e. having the tubular being made up of two sections, where the second section would support and keep the plug assembly parts in place. This is how this kind of plug assemblies are usually supported and built, by adding the assembly components into one section of the tubular, and then holding it all in place by adding a second tubular section. Adding a retainer makes it possible to have only one tubular section, and no crossover. In some applications, such as under high pressure and/or temperature conditions, this is quite desirable, as there is always the potential for a fluid leakage when two tubular sections are joined, i.e. fluid leakage between the annulus and wellbore. Thus, additional welds and seals are avoided.

In an example, the assembly retainer further includes a retainer connector and wherein the retainer connector affixes the retainer assembly to the housing. The housing is the portion of the tubular that accommodates the plug assembly, or it can also refer to a separate element with this function installed in the tubular. The retainer connector can for example be screws or pins or threads on the outside of the retainer that screws into receiving threads on the tubular. Preferably, for added safety, a combination of retainer connectors are used, for example both threads on the retainer and tubular as a main means of affixing the retainer to the tubular and then screws as a safety feature. In this preferred example the screws would keep the retainer from vibrating loose if the tubular is subjected to a lot of vibration during installing in the well, and thus lock the retainer in place once it is screwed into the tubular.

Examples of configurations where the plug 2 does not move is found in FIGS. 8A-10B. Note that the examples of systems and elements given below can be combined with those discussed previously. For these examples the first position is one in which the plug is intact and there is no fluid flow through the plug tubular 1 and a second position where there is fluid flow through the plug tubular 1. The main difference between these examples is that the plug 2 or the breaker object 32 do not need to move with respect to each other. The breaker object 32 refers to the portion of the plug assembly 100 that causes the plug 2 to break when desired. This breaker object 32 can be a seat 4, a portion of the tubular body 12, bearing ring 22, an explosive, or other element that breaks the plug 2.

The plug does not need to move relative to the breaker. This can be accomplished by using an explosive. The explosive is then installed so that when it explodes this breaks the plug. The explosive thus acts as breaker. Another example of breaking the frangible plug in place is to simply apply enough pressure from the wellhead to cause the plug to break against an element that it is contact with. This element then acts as breaker, but without it and the plug moving to contact each other. Rather the element and plug start out in contact and the increased pressure cause the breaking of the plug against the element without relative movement. The plug will then rest on the element and break against it. How much differential pressure is required for breakage can then be adjusted by adjusting the plug (for example making it thinner or of a material that breaks easier if use of less pressure is desired) and/or the element it breaks against (for example making the element of a shape that decreases the contact area, as described above for breakers that move relatively to the plug if use of less pressure is desired). Note that the element can simply be the part of the housing wall that the plug rests against.

Figure 8A:
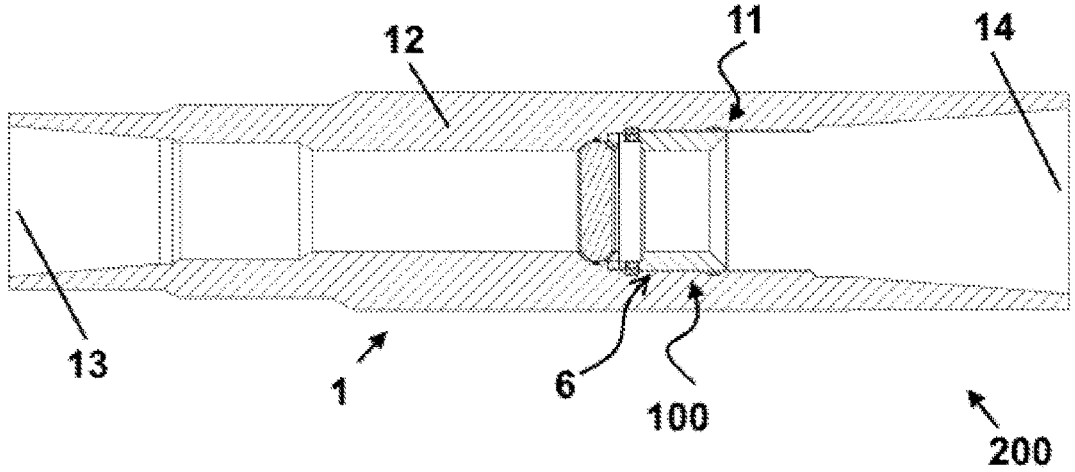
FIG. 8A-8B disclose an embodiment of the plug system with a retainer where the plug does not move.
Figure 8B:
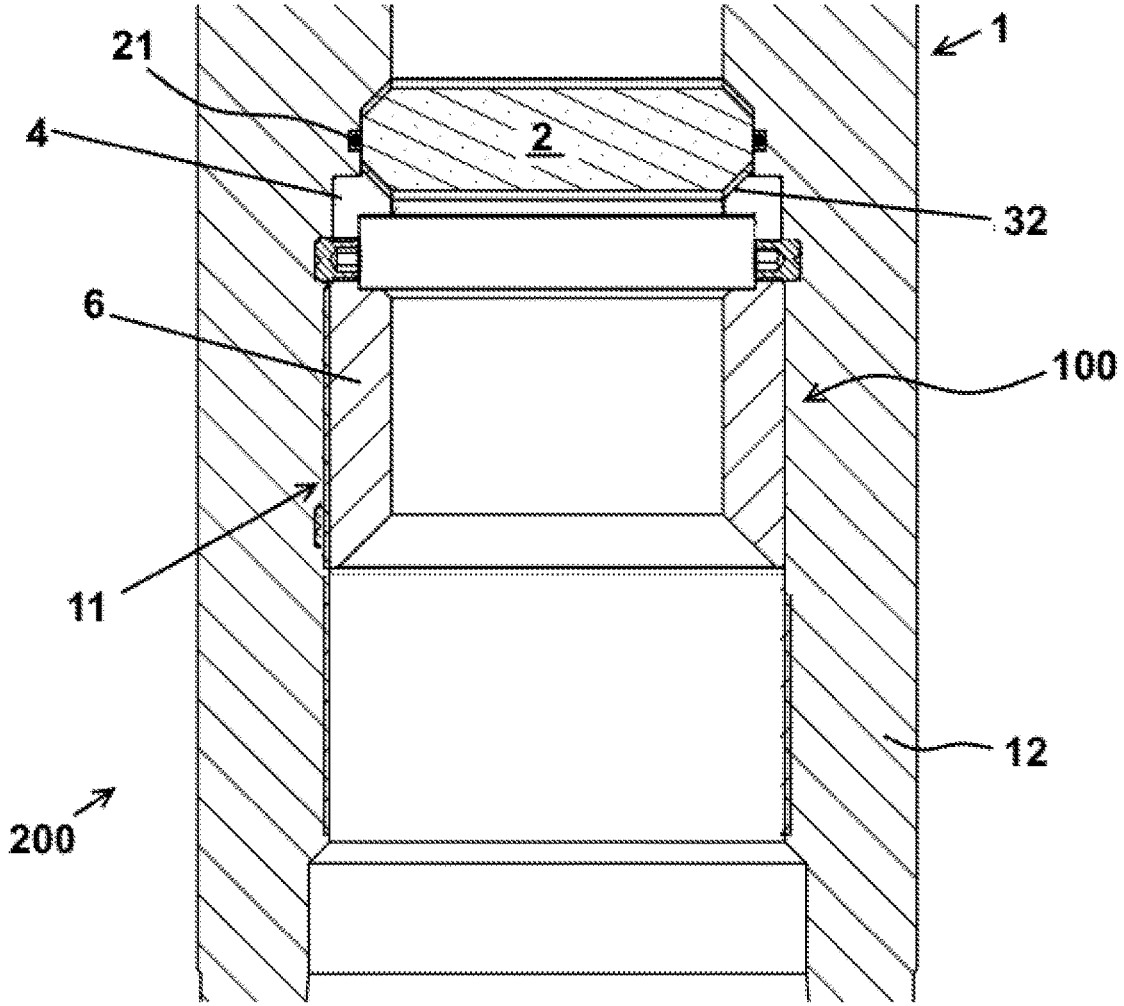

Reference is made to FIG. 8A and FIG. 8B. FIGS. 8A and 8B discloses an example similar to that disclosed previously, except that there is no shear ring 5 and the plug 2 does not move with respect to the breaker object 32 when moving from a first position to a second position. In this example, the assembly retainer 6 holds the seat 4 in place. The housing 11 of the plug assembly 100 is arranged in a tubular body 12. The tubular body 12 is a single continuous piece (though the plug assembly 100 of this time does not require this). In this case the breaker object 32 is a portion of the seat 4. Pressure could be used to apply enough pressure to force the plug 2 into the seat 4 hard enough to cause it to break. Also, the pressure could be high enough to simply exceed the strength of the plug and cause it to break. One advantage of this is that there are fewer moving parts than using a shear ring and having the plug move. Note that while the seat 4 is shown as a separate element from the assembly retainer 6, it would be possible for the seat 4 to be integrated into the assembly retainer 6. While these two figures show a bearing ring 22, as will be shown later, this is not an essential element. The assembly retainer 6 is of the same type as disclosed previously.

Figure 9:
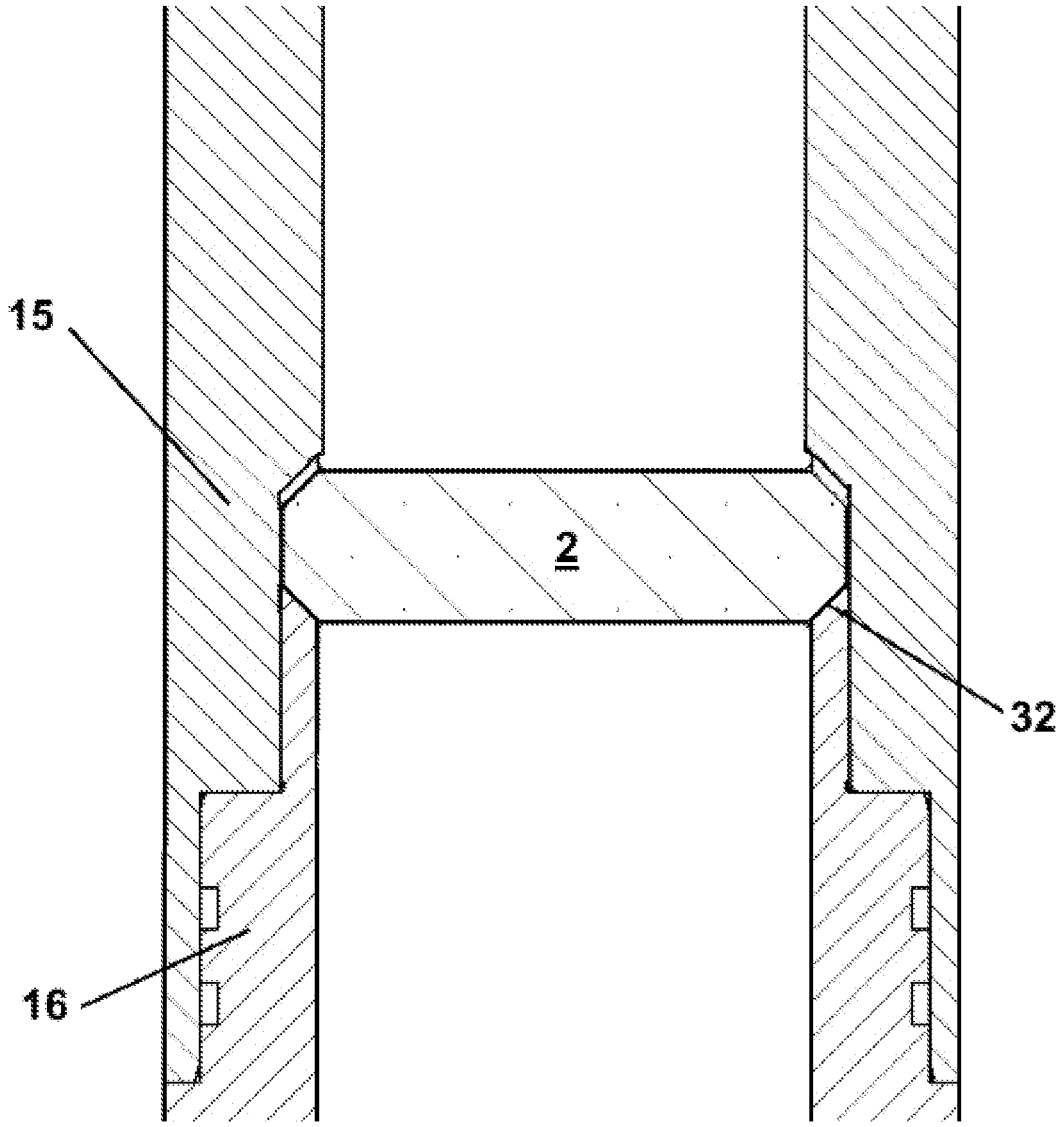
FIG. 9 discloses an embodiment of the plug system where the plug does not move FIG. 10A-B discloses an embodiment of the plug system including an explosive

Reference is made to FIG. 9. FIG. 9 discloses an example in which a plug 2 is resting on a space on top of a second tubular section 16 which is within a first tubular section 15. In this case, there is no seat 4 or assembly retainer 6. In this case the breaker object 32 will be a portion of the second tubular section 16.

Figure 10A:
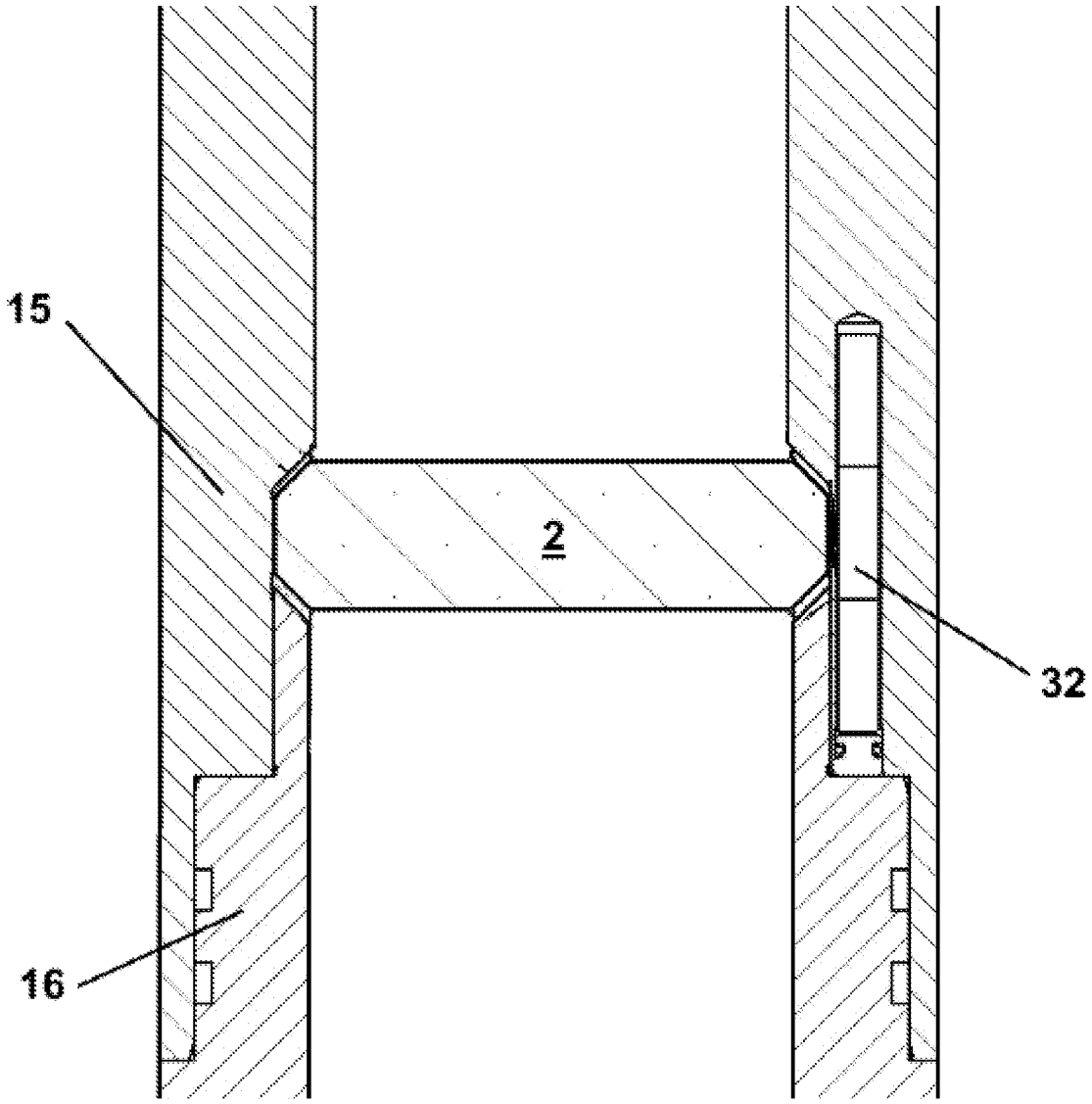
Figure 10B:
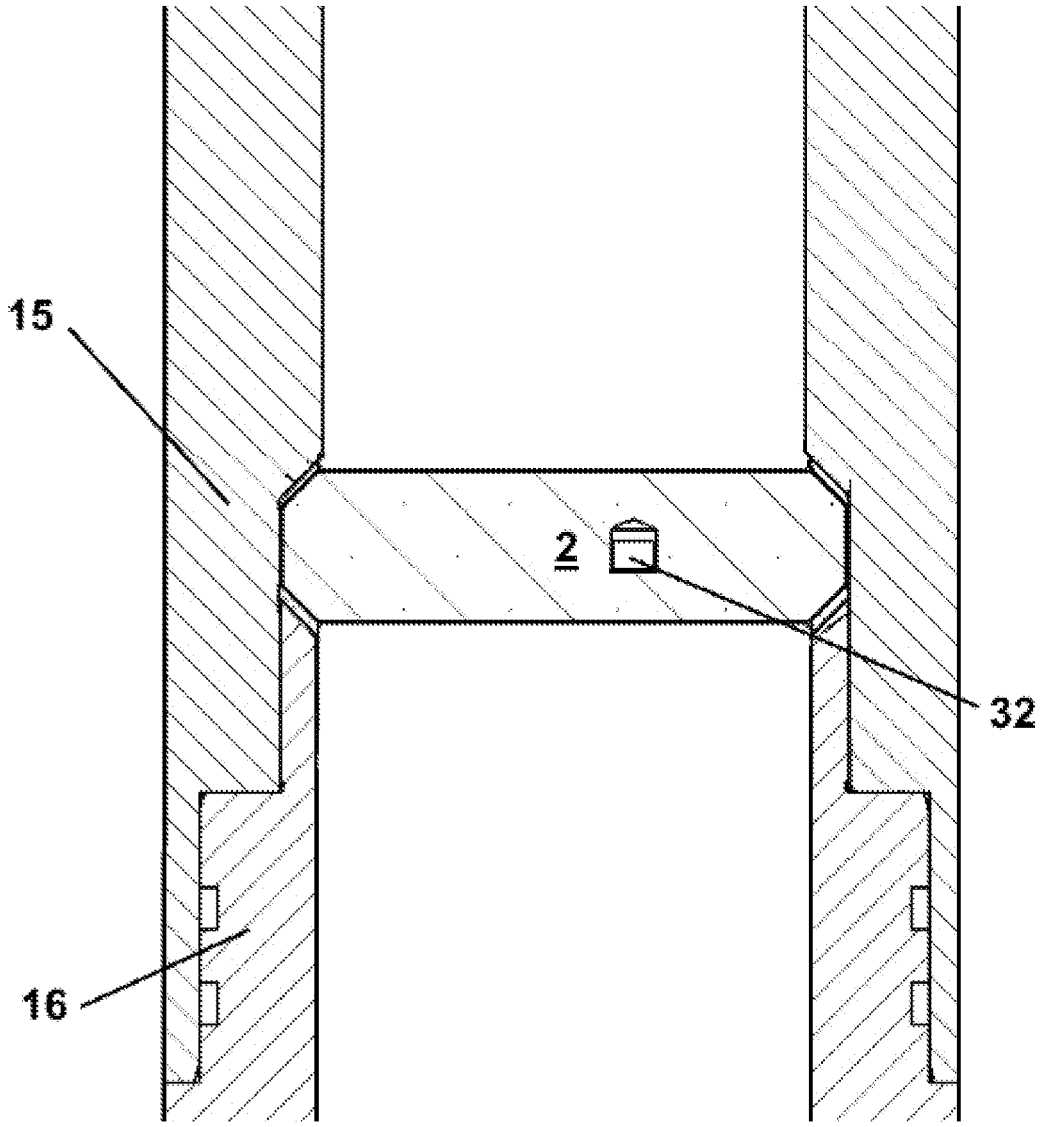

Reference is made to FIGS. 10A and FIG. 10B. FIGS. 10A-10B disclose an explosive as a breaker object 32. In the case of FIG. 10A, this explosive is outside of the plug 2 (preferably in contact with it). In the face of FIG. 10B, the explosive is inside of the plug 2 itself.

Note that the explosive can be part of an embodiment which uses an assembly retainer 6 and/or a tubular body 12 which is a single continuous piece. The explosive can also be part of a system in which the plug rests directly upon the tubular body 12 or on a seat 4.

Please note that "step of" is not to be interpreted as "step for". By "comprised of", "comprising", "comprises" etc. we are referring to an open set and by "consisting of" we are referring to a closed set.

Modifications to the embodiments previously described are possible without departing from the scope of the invention as defined by the accompanying claims. Numerals included within parentheses in the accompanying claims are intended to assist understanding of the claims and should not be construed in any way to limit the subject matter claimed. Reference to the singular is also to be construed as relating to the plural unless expressly stated otherwise. Any reference numbers in the claims are provided as a courtesy and are not to be interpreted as limiting the claim in any way.

It is hereby claimed:

1. A plug assembly (100) arranged in a housing (11) in a tubular body (12) comprising:
- a plug (2);
- a breaker object (32);
- a seat (4); and
- an assembly retainer (6)

wherein:
- the plug (2) is supported by the seat (4);
- the assembly retainer (6) supports the plug assembly (100); and
- the assembly retainer (6) is stationary with respect to the housing (11), and the assembly retainer (6) is a separate element from the tubular body (12);

further:
- the plug assembly (100) has a first position and a second position; wherein:
- in the first position, the plug (2) is intact; and
- in the second position the plug (2) has been broken by the breaker object (32);
- wherein the assembly retainer (6) is fixed to the tubular body (12) by a retainer connector (62), and:
- the plug (2) is stationary with respect to the housing (11) in both the first and second position.

2. The plug assembly (100) according to claim 1, wherein the breaker object (32) is an explosive.

3. The plug assembly (100) according to claim 1, wherein the breaker object (32) is the seat (4).

4. The plug assembly (100) according to claim 1, wherein the assembly retainer (6) comprises threads to affix the retainer assembly (6) to the housing (11).

5. The plug assembly (100) according to claim 1, wherein the assembly retainer (6) further comprises a retainer dampener (64) to absorb force after the plug assembly (100) is no longer in the first position.

6. The plug assembly (100) according to claim 1, wherein the assembly retainer (6) further comprises a retainer body (61) and wherein the retainer body (61) comprises threads to affix the assembly retainer (6) to the housing (11).

7. The plug assembly (100) according to claim 1, wherein the assembly retainer (6) further comprises a plurality of retainer segments (65).

8. The plug assembly (100) according to claim 7, wherein at least one of the plurality of retainer segments (65) comprises a retainer body (61) and a retainer protrusion (66), wherein the retainer protrusion (66) extends from the retainer body (61) in a radial direction.

9. The plug assembly (100) according to claim 7, wherein the plug assembly (100) further comprises a retainer ring (67) to affix the retainer segments (65) to the housing (11), wherein at least a portion of the retainer body (61) is arranged between the housing (11) and a portion of the retainer ring (67).

10. The plug assembly (100) according to claim 1, wherein the breaker object (32) is stationary with respect to the plug (2) between the first and second position.

11. A plug system (200) comprising:
- a plug tubular (1) comprising a tubular body (12), an upstream tubular connection, and a downstream tubular connection; wherein:
  - the upstream tubular connection and the downstream tubular connection are openings at opposite ends of the tubular body (12); and a plug assembly (100) arranged in a housing (11) comprising:

a plug (2);

a breaker object (32); and a seat (4);

wherein:

the plug (2) is supported by the seat (4);

the plug assembly (100) has a first position and a second position; wherein in the first position, the plug (2) intact; and in the second position the plug (2) has been broken by the breaker object (32);

wherein:

the plug (2) is stationary with respect to the housing (11) in both the first and second position;

there is a fluid connection between the upstream tubular connection and the downstream tubular connection: and the tubular body (12) is a single continuous piece; and wherein the plug assembly (100) is entirely arranged within the plug tubular (12).

12. The plug system (200) according to claim 10, wherein the breaker object (32) is an explosive.

13. The plug system (200) according to claim 10, wherein the breaker object (32) is the seat (4).

14. The plug system (200) according to claim 10, wherein the breaker object (32) is stationary with respect to the plug (2) between the first and second position.

15. The plug system (200) according to claim 10, wherein the plug assembly (100) further comprises an assembly retainer (6) arranged to support the breaker (4) or the shear ring (5) and the assembly retainer (6) is stationary with respect to the housing (11).

16. The plug system (200) according to claim 10, wherein the assembly retainer (6) comprises threads to affix the retainer assembly (6) to the housing (11).

17. The plug system (200) according to claim 10, wherein the assembly retainer (6) further comprises a retainer body (61) and wherein the retainer body (61) comprises threads to affix the assembly retainer (6) to the housing (11).

18. The plug system (200) according to claim 10, wherein the assembly retainer (6) further comprises a plurality of retainer segments (65).

19. The plug system (200) according to claim 18, wherein at least one of the plurality of retainer segments (65) comprises a retainer body (61) and a retainer protrusion (66), wherein the retainer protrusion (66) extends from the retainer body (61) in a radial direction.

20. The plug system (200) according to claim 19, wherein the plug system (200) further comprises a retainer ring (67) to affix the retainer segments (65) to the housing (11), wherein at least a portion of the retainer body (61) is arranged between the housing (11) and a portion of the retainer ring (67).

* * * * *